US007534199B2

(12) United States Patent
Krull

(10) Patent No.: US 7,534,199 B2
(45) **Date of Patent: *May 19, 2009**

(54) WEIGHT SELECTION METHODS AND APPARATUS

(75) Inventor: Mark A. Krull, Bend, OR (US)

(73) Assignee: Nautilus, Inc., Vancouver, WA (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/425,064

(22) Filed: Jun. 19, 2006

(65) Prior Publication Data

US 2006/0223684 A1 Oct. 5, 2006

Related U.S. Application Data

(63) Continuation of application No. 10/127,049, filed on Apr. 18, 2002, now Pat. No. 7,077,791.

(51) Int. Cl.
*A63B 21/075* (2006.01)

(52) U.S. Cl. ..... 482/108; 482/98; 482/107

(58) Field of Classification Search ..... 482/106–108, 482/93–94, 98
See application file for complete search history.

(56) References Cited

U.S. PATENT DOCUMENTS

| | | | |
|---|---|---|---|
| 772,906 | A | 10/1904 | Reach |
| 848,272 | A | 3/1907 | Thomley |
| 1,053,109 | A | 2/1913 | Reach |
| 1,422,888 | A | 7/1922 | Reeves et al. |
| 1,672,944 | A | 6/1928 | Jowett |
| 1,779,594 | A | 10/1930 | Hall |
| 1,917,566 | A | 7/1933 | Wood |
| 2,447,218 | A | 8/1948 | Trzesniewski |
| 3,647,209 | A | 3/1972 | La Lanne |
| 3,758,109 | A | 9/1973 | Bender |
| 3,771,785 | A | 11/1973 | Speyer |
| 3,825,253 | A | 7/1974 | Speyer |
| 3,912,261 | A | 10/1975 | Lambert, Sr. |
| 3,913,908 | A | 10/1975 | Speyer |
| D244,628 | S | 6/1977 | Wright |
| 4,029,312 | A | 6/1977 | Wright |

(Continued)

FOREIGN PATENT DOCUMENTS

| | | |
|---|---|---|
| CH | 384485 | 11/1964 |

(Continued)

OTHER PUBLICATIONS

UK fitness supplies.co.uk, located at http://www.ukfitnesssupplies.co.uk, 3 pages (First publ. date unknown, website pages printed on Aug. 4, 2003).

(Continued)

*Primary Examiner*—Fenn C Mathew
(74) *Attorney, Agent, or Firm*—Dorsey & Whitney LLP

(57) ABSTRACT

An exercise dumbbell has at least one weight selector that is rotatable into engagement with various combination of weights at opposite ends of the handle. On a first embodiment, first and second weight selectors are rotatably mounted on opposite ends of a bar for independent rotation relative to the handle. On a second embodiment, first and second weight selectors are keyed to a common bar and rotated together therewith relative to the handle.

20 Claims, 13 Drawing Sheets

U.S. PATENT DOCUMENTS

| | | | | |
|---|---|---|---|---|
| 4,076,236 | A | 2/1978 | Ionel | |
| 4,349,192 | A | 9/1982 | Lambert, Jr. et al. | |
| RE31,113 | E | 12/1982 | Coker et al. | |
| 4,411,424 | A | 10/1983 | Barnett | |
| 4,453,710 | A | 6/1984 | Plötz | |
| 4,529,197 | A * | 7/1985 | Gogarty | 482/107 |
| 4,529,198 | A * | 7/1985 | Hettick, Jr. | 482/104 |
| 4,538,805 | A | 9/1985 | Parviainen | |
| 4,540,171 | A | 9/1985 | Clark et al. | |
| 4,546,971 | A | 10/1985 | Raasoch | |
| 4,566,690 | A * | 1/1986 | Schook | 482/108 |
| 4,568,078 | A | 2/1986 | Weiss | |
| 4,575,074 | A | 3/1986 | Damratoski | |
| 4,579,337 | A | 4/1986 | Uyeda | |
| 4,601,466 | A | 7/1986 | Lais | |
| 4,624,457 | A | 11/1986 | Silberman et al. | |
| 4,627,615 | A | 12/1986 | Nurkowski | |
| 4,627,618 | A | 12/1986 | Schwartz | |
| 4,651,988 | A | 3/1987 | Sobel | |
| 4,712,793 | A | 12/1987 | Harwick et al. | |
| 4,730,828 | A | 3/1988 | Lane | |
| 4,743,017 | A | 5/1988 | Jaeger | |
| 4,768,780 | A | 9/1988 | Hayes | |
| 4,787,629 | A | 11/1988 | DeMyer | |
| 4,809,973 | A | 3/1989 | Johns | |
| 4,822,034 | A * | 4/1989 | Shields | 482/106 |
| 4,834,365 | A | 5/1989 | Jones | |
| 4,878,662 | A | 11/1989 | Chern | |
| 4,878,663 | A | 11/1989 | Luquette | |
| 4,880,229 | A | 11/1989 | Broussard | |
| 4,900,016 | A | 2/1990 | Caruthers | |
| 4,900,018 | A | 2/1990 | Ish, III et al. | |
| D307,168 | S | 4/1990 | Vodhanel | |
| 4,913,422 | A | 4/1990 | Elmore et al. | |
| 4,948,123 | A | 8/1990 | Schook | |
| 4,971,305 | A | 11/1990 | Rennex | |
| 4,982,957 | A | 1/1991 | Shields | |
| D315,003 | S | 2/1991 | Huang | |
| 5,000,446 | A | 3/1991 | Sarno | |
| 5,037,089 | A | 8/1991 | Spagnuolo et al. | |
| 5,040,787 | A | 8/1991 | Brotman | |
| D321,230 | S | 10/1991 | Leonesio | |
| 5,102,124 | A | 4/1992 | Diodati | |
| 5,123,885 | A | 6/1992 | Shields | |
| 5,131,898 | A | 7/1992 | Panagos | |
| 5,135,453 | A | 8/1992 | Sollenberger | |
| D329,563 | S | 9/1992 | Rasmussen | |
| 5,171,199 | A | 12/1992 | Panagos | |
| 5,221,244 | A | 6/1993 | Doss | |
| 5,256,121 | A | 10/1993 | Brotman | |
| 5,263,915 | A | 11/1993 | Habing | |
| 5,284,463 | A | 2/1994 | Shields | |
| 5,306,221 | A | 4/1994 | Itaru | |
| 5,344,375 | A | 9/1994 | Cooper | |
| 5,374,229 | A | 12/1994 | Sencil | |
| 5,407,413 | A | 4/1995 | Kupferman | |
| D359,778 | S | 6/1995 | Towley, III et al. | |
| 5,433,687 | A | 7/1995 | Hinzman et al. | |
| 5,435,800 | A | 7/1995 | Nelson | |
| D362,776 | S | 10/1995 | Thorn | |
| 5,484,367 | A | 1/1996 | Martinez | |
| 5,607,379 | A | 3/1997 | Scott | |
| 5,628,716 | A | 5/1997 | Brice | |
| 5,630,776 | A | 5/1997 | Yang | |
| 5,637,064 | A | 6/1997 | Olson et al. | |
| 5,669,861 | A | 9/1997 | Toups | |
| 5,735,777 | A | 4/1998 | Benoit et al. | |
| 5,749,814 | A | 5/1998 | Chen | |
| 5,769,762 | A | 6/1998 | Towley, III et al. | |
| 5,776,040 | A | 7/1998 | Webb et al. | |
| 5,779,604 | A | 7/1998 | Towley, III et al. | |
| 5,839,997 | A | 11/1998 | Roth et al. | |
| 5,853,355 | A | 12/1998 | Standish | |
| 5,876,313 | A | 3/1999 | Krull | |
| 5,879,274 | A | 3/1999 | Mattox | |
| 5,971,899 | A | 10/1999 | Towley, III et al. | |
| 6,014,078 | A * | 1/2000 | Rojas et al. | 340/568.6 |
| 6,033,350 | A | 3/2000 | Krull | |
| 6,039,678 | A | 3/2000 | Dawson | |
| D422,654 | S | 4/2000 | Chen | |
| 6,083,144 | A | 7/2000 | Towley, III et al. | |
| 6,099,442 | A | 8/2000 | Krull | |
| 6,117,049 | A | 9/2000 | Lowe | |
| 6,120,420 | A | 9/2000 | Pearson et al. | |
| 6,123,651 | A | 9/2000 | Ellenburg | |
| 6,149,558 | A | 11/2000 | Chen | |
| 6,186,927 | B1 | 2/2001 | Krull | |
| 6,186,928 | B1 | 2/2001 | Chen | |
| 6,196,952 | B1 * | 3/2001 | Chen | 482/107 |
| 6,228,003 | B1 * | 5/2001 | Hald et al. | 482/107 |
| 6,261,022 | B1 | 7/2001 | Dalebout et al. | |
| 6,261,211 | B1 | 7/2001 | Suarez et al. | |
| 6,322,481 | B1 | 11/2001 | Krull | |
| 6,328,678 | B1 | 12/2001 | Romero | |
| 6,350,221 | B1 | 2/2002 | Krull | |
| 6,402,666 | B2 | 6/2002 | Krull | |
| 6,416,446 | B1 | 7/2002 | Krull | |
| 6,422,979 | B1 * | 7/2002 | Krull | 482/98 |
| 6,436,013 | B1 | 8/2002 | Krull | |
| 6,461,282 | B1 | 10/2002 | Fenelon | |
| 6,500,101 | B1 * | 12/2002 | Chen | 482/107 |
| D468,946 | S | 1/2003 | Harms et al. | |
| D469,294 | S | 1/2003 | Harms et al. | |
| 6,540,650 | B1 | 4/2003 | Krull | |
| 6,582,345 | B2 | 6/2003 | Roy | |
| 6,595,902 | B1 | 7/2003 | Savage et al. | |
| 6,629,910 | B1 | 10/2003 | Krull | |
| 6,656,093 | B2 | 12/2003 | Chen | |
| 6,669,606 | B2 * | 12/2003 | Krull | 482/98 |
| 6,679,816 | B1 | 1/2004 | Krull | |
| 6,682,464 | B2 | 1/2004 | Shifferaw | |
| 6,719,672 | B1 | 4/2004 | Ellis et al. | |
| 6,719,674 | B2 | 4/2004 | Krull | |
| 6,733,424 | B2 | 5/2004 | Krull | |
| 6,746,381 | B2 | 6/2004 | Krull | |
| 6,749,547 | B2 * | 6/2004 | Krull | 482/106 |
| D498,272 | S | 11/2004 | Sanford-Schwentke et al. | |
| D500,820 | S | 1/2005 | Krull | |
| 6,837,833 | B2 | 1/2005 | Elledge | |
| 6,855,097 | B2 | 2/2005 | Krull | |
| 6,872,173 | B2 | 3/2005 | Krull | |
| 6,902,516 | B2 | 6/2005 | Krull | |
| D508,628 | S | 8/2005 | Crawford et al. | |
| 6,974,405 | B2 | 12/2005 | Krull | |
| 7,077,790 | B1 | 7/2006 | Krull | |
| 7,077,791 | B2 * | 7/2006 | Krull | 482/108 |
| D528,611 | S | 9/2006 | Flick et al. | |
| 7,153,243 | B1 | 12/2006 | Krull | |
| D540,405 | S | 4/2007 | Crawford et al. | |
| D540,894 | S | 4/2007 | Crawford et al. | |
| 2003/0148862 | A1 * | 8/2003 | Chen et al. | 482/108 |
| 2004/0005968 | A1 | 1/2004 | Crawford et al. | |
| 2004/0005969 | A1 | 1/2004 | Chen | |
| 2004/0023765 | A1 | 2/2004 | Krull | |
| 2004/0072661 | A1 | 4/2004 | Krull | |
| 2004/0138031 | A1 | 7/2004 | Krull | |
| 2004/0220025 | A1 | 11/2004 | Krull | |
| 2005/0079961 | A1 | 4/2005 | Dalebout et al. | |
| 2006/0105889 | A1 | 5/2006 | Webb | |
| 2006/0205571 | A1 | 9/2006 | Krull | |
| 2006/0211550 | A1 | 9/2006 | Crawford et al. | |

2006/0217245 A1 9/2006 Golesh et al.

FOREIGN PATENT DOCUMENTS

| | | | |
|---|---|---|---|
| CN | 2409998 | Y | 12/2000 |
| CN | 2426370 | Y | 4/2001 |
| CN | 2430184 | Y | 5/2001 |
| EP | 177643 | A1 | 4/1986 |
| FR | 637365 | | 4/1928 |
| FR | 1263930 | | 5/1961 |
| FR | 1468902 | | 4/1967 |
| FR | 2452296 | | 10/1980 |
| FR | 2459056 | A | 2/1981 |
| FR | 2613237 | | 10/1988 |
| JP | 10118222 | | 5/1998 |
| SE | 455573 | | 7/1988 |
| SU | 1258447 | A1 | 9/1986 |
| SU | 1367987 | A1 | 1/1988 |
| SU | 1389789 | A2 | 4/1988 |
| SU | 1643024 | A1 | 4/1991 |
| SU | 1659073 | A1 | 6/1991 |
| SU | 1687271 | A1 | 10/1991 |
| SU | 1780780 | A1 | 12/1992 |
| WO | WO 03/063969 | A2 | 8/2003 |
| WO | WO 03/063969 | A3 | 8/2003 |
| WO | WO 03/089070 | A1 | 10/2003 |

OTHER PUBLICATIONS

Office Action Summary and Detailed Action, U.S. Appl. No. 08/886,607, mailed Apr. 30, 1998, 5 pages.
Response, U.S. Appl. No. 08/886,607, dated May 20, 1998, 2 pages.
Office Action Summary, Detailed Action, and PTO-892, U.S. Appl. No. 08/886,607, mailed Aug. 17, 1998, 11 pages.
Amendment and Response and red-lined drawing sheets, U.S. Appl. No. 08/886,607, dated Nov. 4, 1998, 18 pages.
Interview Summary, U.S. Appl. No. 08/886,607, mailed Oct. 29, 1998, 5 pages.
Notice of Allowance and Notice of Allowability, U.S. Appl. No. 08/886,607, mailed Nov. 23, 1998, 2 pages.
Office Action and PTO-892, U.S. Appl. No. 09/259,732, mailed Jul. 12, 1999, 9 pages.
Amendment and Response, U.S. Appl. No. 09/259,732, dated Oct. 6, 1999, 8 pages.
Office Action and PTO-892, U.S. Appl. No. 09/259,732, mailed Jan. 6, 2000, 8 pages.
Amendment and Response, U.S. Appl. No. 09/259,732, dated Apr. 6, 2000, 9 pages.
Office Action, U.S. Appl. No. 09/259,732, mailed Jul. 5, 2000, 7 pages.
Amendment and Response to Final Office Action Rejection, U.S. Appl. No. 09/259,732, dated Aug. 28, 2000, 3 pages.
Terminal Disclaimer, U.S. Appl. No. 09/259,732, dated Aug. 28, 2000, 1 page.
Notice of Allowance, Notice of Allowability, Examiner's Amendment, and Interview Summary, U.S. Appl. No. 09/259,732, mailed Sep. 18, 2000, 4 pages.
Office Action, U.S. Appl. No. 09/300,546, mailed Sep. 29, 2000, 5 pages.
Amendment and Response, U.S. Appl. No. 09/300,546, dated Oct. 30, 2000, 3 pages.
Office Action and PTO-892, U.S. Appl. No. 09/300,546, mailed Feb. 20, 2001, 8 pages.
Amendment and Response, U.S. Appl. No. 09/300,546, dated May 21, 2001, 8 pages.
Office Communication, U.S. Appl. No. 09/300,546, mailed May 31, 2001, 2 pages.
Substitute Amendment and Response, U.S. Appl. No. 09/300,546, dated Jun. 26, 2001, 3 pages.
Office Action, U.S. Appl. No. 09/300,546, mailed Sep. 11, 2001, 5 pages.
Amendment and Response to Final Rejection and Terminal Disclaimer, U.S. Appl. No. 09/300,546, dated Nov. 15, 2001, 5 pages.
Notice of Allowance, Notice of Allowability, and Examiner's Amendment, U.S. Appl. No. 09/300,546, mailed Feb. 14, 2002, 4 pages.
Office Action, U.S. Appl. No. 09/745,822, mailed Sep. 10, 2002, 4 pages.
Amendment and Response, U.S. Appl. No. 09/745,822, dated Oct. 10, 2002, 6 pages.
Office Action and PTO-892, U.S. Appl. No. 09/745,822, mailed Jan. 2, 2003, 9 pages.
Amendment and Response and Terminal Disclaimer, U.S. Appl. No. 09/745,822, dated Apr. 30, 2003, 14 pages.
Notice of Allowance, Notice of Allowability, and Detailed Action, U.S. Appl. No. 09/745,822, mailed Jul. 29, 2003, 4 pages.
Office Action and PTO-892, U.S. Appl. No. 10/867,834, mailed Jul. 14, 2005, 7 pages.
Amendment and Response, U.S. Appl. No. 10/867,834, dated Nov. 14, 2005, 10 pages.
Office Action, U.S. Appl. No. 10/867,834, mailed Feb. 7, 2006, 7 pages.
Response After Final Rejection and Terminal Disclaimer, U.S. Appl. No. 10/867,834, dated Jun. 6, 2006, 3 pages.
Notice of Allowance and Notice of Allowability, U.S. Appl. No. 10/867,834, mailed Jun. 22, 2006, 2 pages.
Office Action and PTO-892, U.S. Appl. No. 11/377,718, mailed Aug. 3, 2007, 10 pages.
Amendment and Response to Office Action, U.S. Appl. No. 11/377,718, dated Nov. 5, 2007, 12 pages.
Office Action and PTO-892, U.S. Appl. No. 10/824,338, mailed Jul. 26, 2005, 6 pages.
Amendment and Response and Terminal Disclaimer, U.S. Appl. No. 10/824,338, dated Nov. 28, 2005, 8 pages.
Notice of Allowance, Notice of Allowability, and Detailed Action, U.S. Appl. No. 10/824,338, mailed Feb. 27, 2006, 4 pages.
Preliminary Amendment, U.S. Appl. No. 10/456,977, dated Mar. 22, 2005, 9 pages.
Office Action, U.S. Appl. No. 10/456,977, mailed Mar. 22, 2006, 5 pages.
Amendment and Response to Office Action, U.S. Appl. No. 10/456,977, dated May 18, 2006, 9 pages.
Office Action and PTO-892, U.S. Appl. No. 10/456,977, mailed Aug. 9, 2006, 13 pages.
Amendment and Response, annotated and replacement drawing sheets, U.S. Appl. No. 10/456,977, dated Feb. 9, 2007, 45 pages.
Notice of Allowance, Notice of Allowability, Examiner's Amendment, and PTO-892, U.S. Appl. No. 10/456,977, mailed Apr. 26, 2007, 5 pages.
Office Action and PTO-892, U.S. Appl. No. 11/437,795, mailed Apr. 5, 2007, 10 pages.
Amendment and Response, annotated and replacement drawing sheets, U.S. Appl. No. 11/437,795, dated Sep. 5, 2007, 42 pages.
Office Action and PTO-892, U.S. Appl. No. 11/437,795, mailed Dec. 11, 2007, 15 pages.
Non-Final Office Action, Office Action Summary, Detailed Action, and PTO-892, U.S. Appl. No. 10/127,049, mailed Oct. 4, 2004, 5 pages.
Amendment and Response and Terminal Disclaimer, U.S. Appl. No. 10/127,049, dated Apr. 4, 2005, 6 pages.
Notice of Allowance, Notice of Allowability, and Detailed Action, U.S. Appl. No. 10/127,049, mailed Jun. 24, 2005, 4 pages.
Notice of Allowance, Notice of Allowability, and Detailed Action, U.S. Appl. No. 10/127,049, mailed Mar. 7, 2006, 4 pages.
Notice of Allowance, Examiner's Amendment, Interview Summary, and PTO-892, U.S. Appl. No. 09/010,863, mailed Jun. 11, 1998, 10 pages.
First Preliminary Amendment, U.S. Appl. No. 11/044,410, dated Mar. 16, 2006, 15 pages.
Notice of Allowance, Examiner's Amendment, Interview Summary, Examiner-Initiated Interview Summary, and PTO-892, U.S. Appl. No. 11/044,410, mailed Jun. 2, 2006, 11 pages.

* cited by examiner 169
168
167
160

169
168
167
160

169
168
167
160

169
168
167
160

169
168
167
160

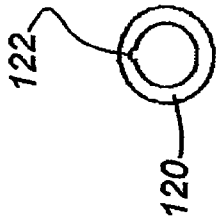
Fig. 26
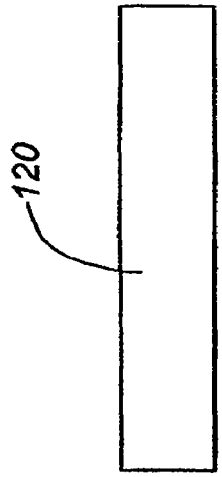
Fig. 25
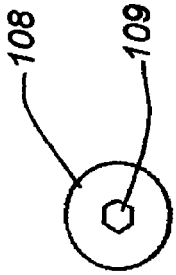
Fig. 27
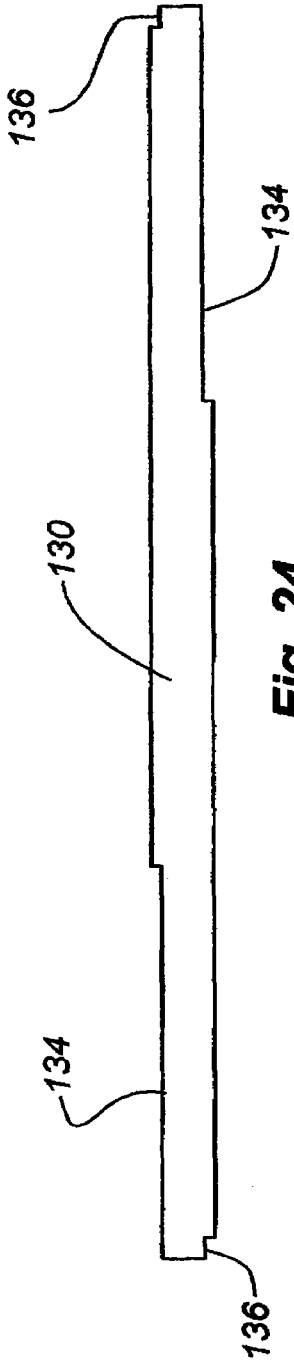
Fig. 24
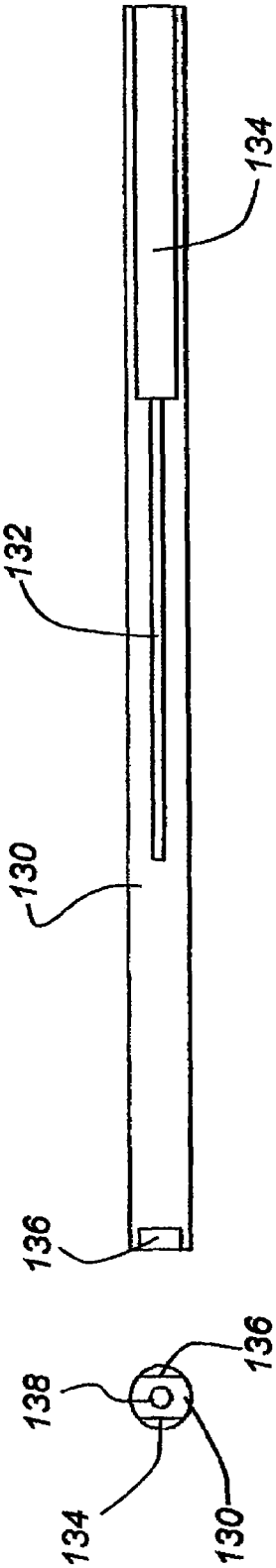
Fig. 22
Fig. 23

WEIGHT SELECTION METHODS AND APPARATUS

CROSS REFERENCE TO RELATED APPLICATION

This application is a continuation of U.S. application Ser. No. 10/127,049, filed on Apr. 18, 2002, now U.S. Pat. No. 7,077,791, and entitled "Weight Selection Methods and Apparatus", which is hereby incorporated by reference as if fully disclosed herein.

FIELD OF THE INVENTION

The present invention relates to exercise equipment and more particularly, to weight selection methods and apparatus for free weights such as dumbbells and barbells.

BACKGROUND OF THE INVENTION

Various weight selection methods and apparatus have been developed to provide adjustable resistance to exercise. With respect to free weights, weight plates are typically mounted on opposite ends of a bar. In relatively advanced systems, the bar or handle assembly is stored in proximity to the weight plates, and at least one selection mechanism is provided to connect a desired amount of mass to the bar.

Some examples of patented barbell/dumbbell improvements and/or features are disclosed in U.S. Pat. No. 4,529,198 to Hettick, Jr. (discloses a barbell assembly having opposite end weights that are maintained in alignment on respective storage members and selectively connected to a handle by means of axially movable springs); U.S. Pat. No. 4,822,034 to Shields (discloses both barbell and dumbbell assemblies having opposite end weights that are maintained in alignment on a shelf and selectively connected to a handle by means of latches on the weights); U.S. Pat. No. 5,284,463 to Shields (discloses a dumbbell assembly having opposite end weights that are maintained in alignment on a base and selectively connected to a handle by means of cam driven pins on the weights); U.S. Pat. No. 5,637,064 to Olson et al. (discloses a dumbbell assembly having a plurality of interconnected opposite end weights that are stored in nested relationship to one another and selectively connected to a handle by means of a U-shaped pin); U.S. Pat. No. 5,769,762 to Towley, III et al. (discloses a dumbbell assembly having a plurality of interconnected opposite end weights that are stored in nested relationship to one another and selectively connected to a handle by various means); U.S. Pat. No. 5,839,997 to Roth et al. (discloses a dumbbell assembly having opposite end weights that are maintained in alignment on a base and selectively connected to a handle by means of eccentric cams on a rotating selector rod); and U.S. Pat. No. 6,033,350 to Krull (discloses a dumbbell assembly having opposite end weights that are maintained in alignment on a base and selectively connected to a handle by means of respective first and second selector rods that move axially in opposite directions). Despite these advances and others in the field of weight selection, room for improvement and continued innovation remains.

SUMMARY OF THE INVENTION

The present invention provides weight selectors that occupy spaces between adjacent weights and rotate through a range of orientations to alternatively engage and disengage various combinations of the weights. Each weight selector is configured to engage any combination of at least two weights. Many features and advantages of the present invention will become apparent from the more detailed description that follows.

BRIEF DESCRIPTION OF THE FIGURES OF THE DRAWING

With reference to the Figures of the Drawing, wherein like numerals represent like parts and assemblies throughout the several views.

FIG. 22 is a side view of a bar on the dumbbell of FIG. 1;

FIG. 23 is an end view of the bar of FIG. 22;

FIG. 24 is a top view of the bar of FIG. 22;

FIG. 25 is a side view of a handle on the dumbbell of FIG. 1;

FIG. 26 is an end view of the handle of FIG. 25;

FIG. 27 is an end view of a fastener on the dumbbell of FIG. 1;

DETAILED DESCRIPTION OF THE PREFERRED EMBODIMENT

The present invention provides methods and apparatus to facilitate adjustment of weight resistance to exercise motion. Generally speaking, the present invention allows a person to adjust weight resistance by rotating one or more weight selectors into engagement with a desired combination of weights.

Figure 1:
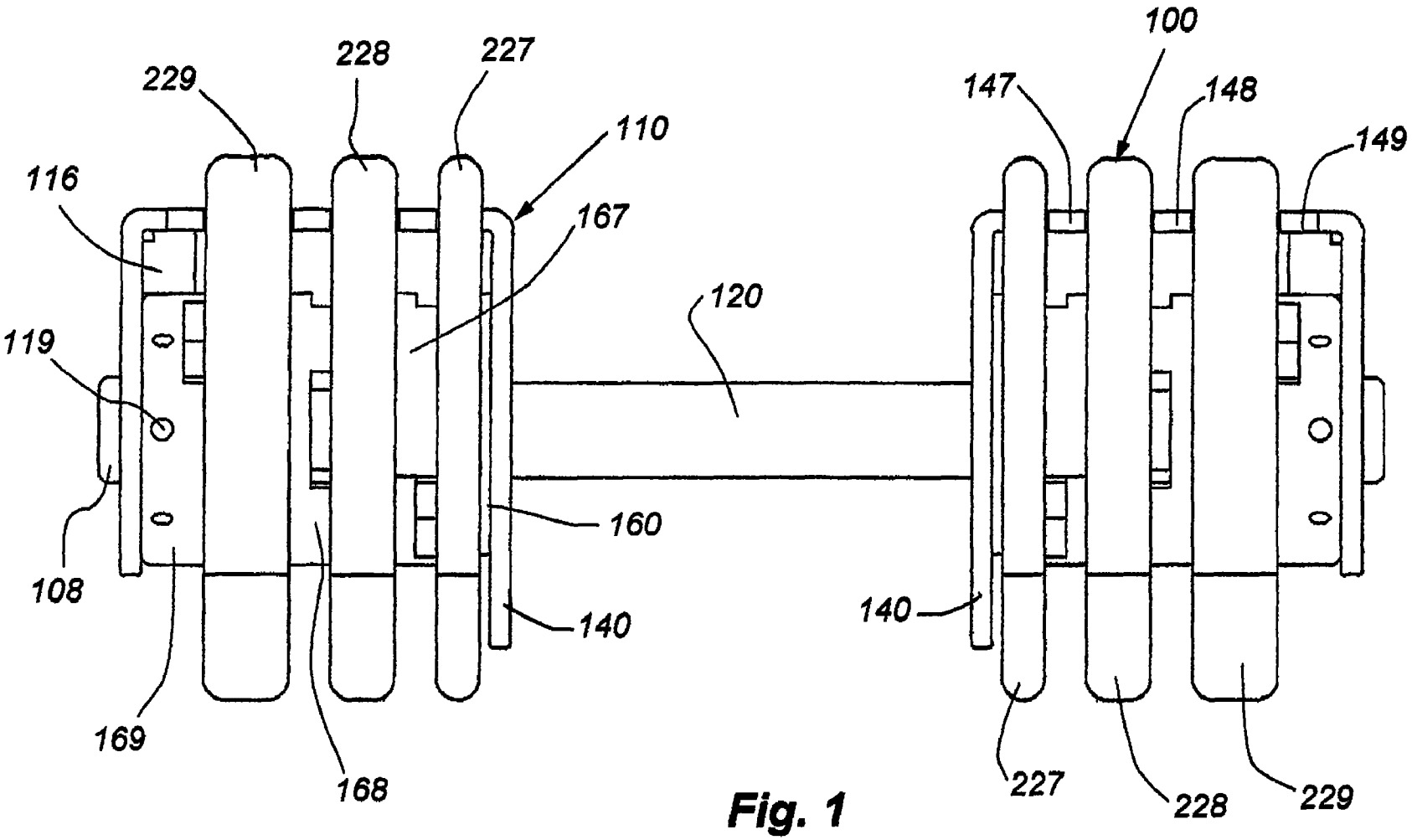
FIG. 1 is a side view of an exercise dumbbell constructed according to the principles of the present invention.

FIG. 1 shows an exercise dumbbell 100 constructed according to the principles of the present invention. The dumbbell 100 includes a handle assembly 110 and a plurality of weight plates 227-229 that are selectively connected to the handle assembly 110.

Figure 2:
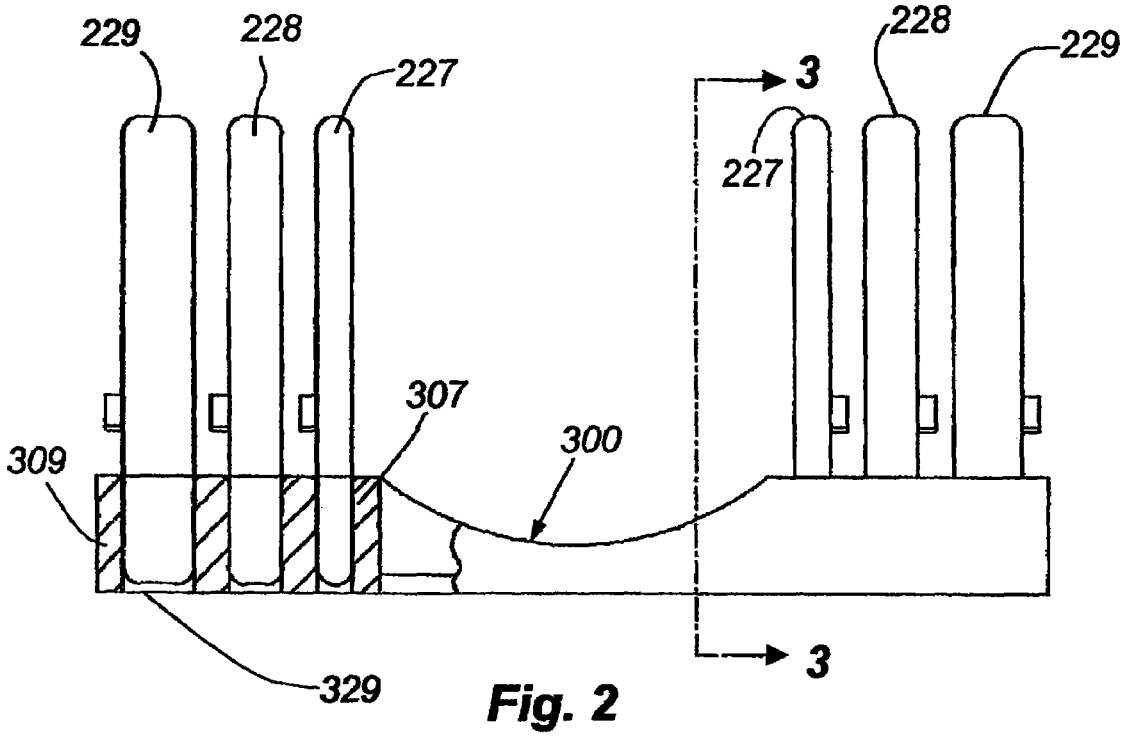
FIG. 2 is a partially sectioned side view of a weight base and a plurality of weight plates suitable for use with the dumbbell of FIG. 1.

As shown in FIG. 2, the weight plates 227-229 rest on a weight base or cradle 300 when not in use. The base 300 is preferably an injection molded plastic member having an intermediate portion, and respective weight storage areas at opposite ends of the intermediate portion. Each weight storage area is defined by a plurality of side walls, end walls, and spacers which cooperate to define discrete weight upwardly opening slots or compartments 327-329.

Figure 3:
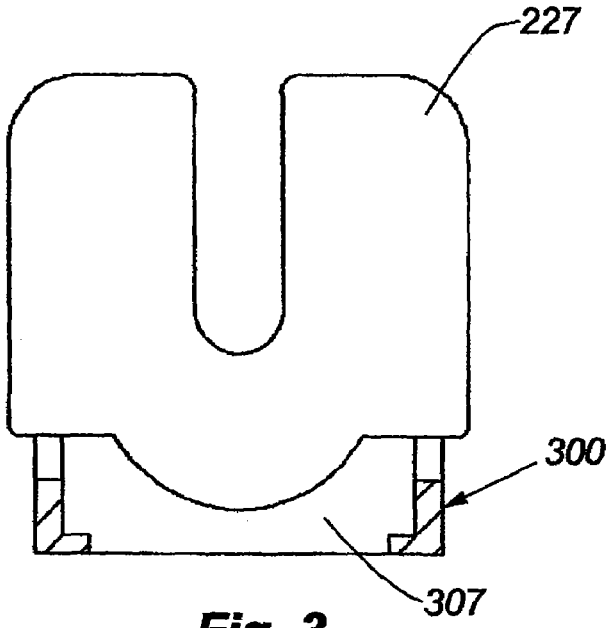
FIG. 3 is a sectioned end view of the weight base and weights of FIG. 2.

The upper corners on these walls and spacers are preferably beveled and/or rounded to help guide the weight plates 227-229 into place. Also, each end wall 307 and 309 is preferably contoured or notched (as shown in FIG. 3) for reasons discussed below. The depicted base 300 does not require a bottom wall because of the manner in which the weight plates 227-229 are configured, but the present invention is not limited to such an arrangement. Some other weight storage arrangements are disclosed in U.S. Pat. No. 4,529,198 to Hettick, Jr.; U.S. Pat. No. 4,822,034 to Shields; U.S. Pat. No. 5,284,463 to Shields; U.S. Pat. No. 5,839,997 to Roth et al.; and U.S. Pat. No. 6,033,350 to Krull, all of which are incorporated herein by reference.

Figure 6:
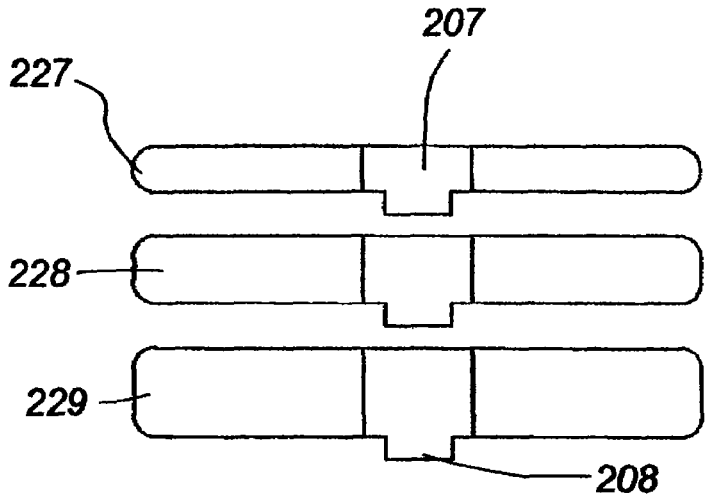
FIG. 6 is a top view of the weight plates of FIG. 4.
Figure 5:
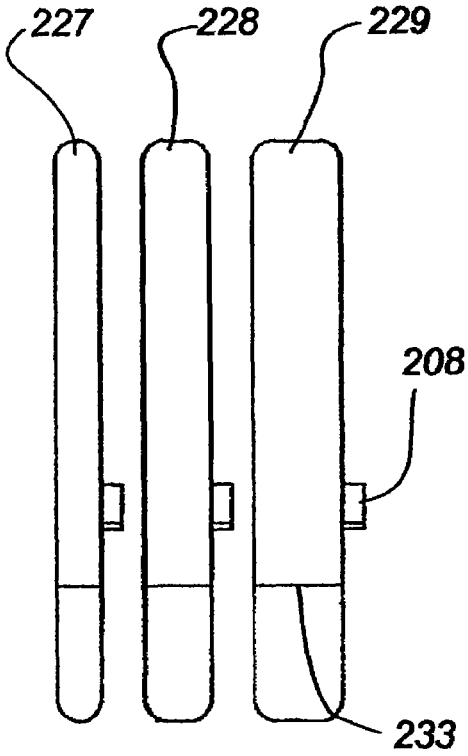
FIG. 5 is a side view of the weight plates of FIG. 4.
Figure 4:
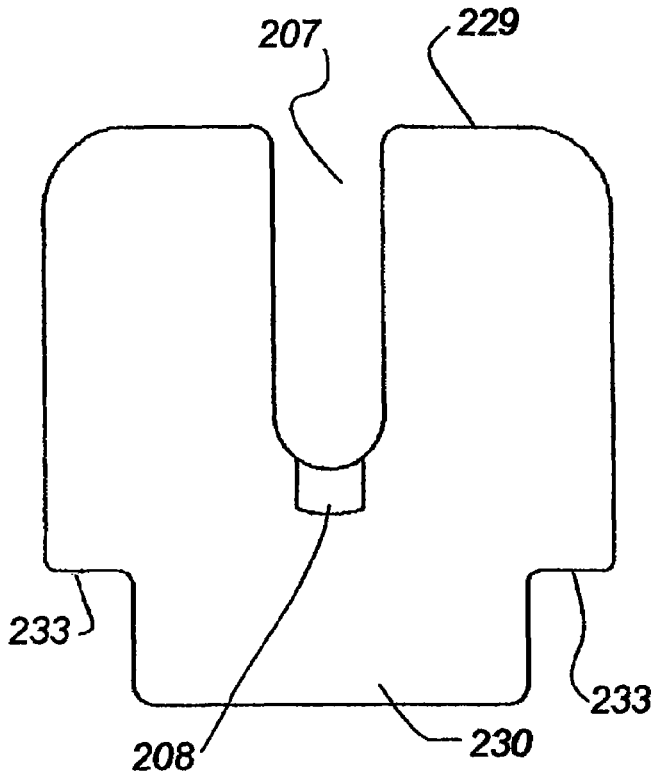
FIG. 4 is an end view of the weight plates of FIG. 3 without the weight base.

FIGS. 4-6 show one group of weight plates 227-229 by themselves, though arranged as if supported by the base 300. With the exception of thickness, the weight plates 227-229 are identical to one another. The weight plates 227-229 are preferably made of steel. For the dumbbell 100, the weight plates 227 are configured to weigh five pounds each; the weight plates 228 are configured to weigh seven and one-half pounds each; and the weight plates 229 are configured to weigh ten pounds each. Those skilled in the art will recognize that different weight amounts may be selected as a matter of design choice. In this particular case, the selected weights are deemed a desirable choice for reasons discussed below.

As shown in FIGS. 4-6, each of the weight plates 227-229 has an upwardly opening slot 207, and a peg or nub 208 that is disposed immediately beneath the slot 207 and protrudes orthogonally outward from the plate. The lower corners of each plate 227-229 are notched to provide a relatively narrower lower end 230, and laterally extending, downwardly facing shoulders 233 on opposite sides thereof. These notches tend to offset the impact of the slot 207 for purposes of maintaining proximity between the center of mass and the geometric center of the weight plate. Also, the narrow end 230 is configured to fit inside a respective slot 327-329 in the base 300, and the shoulders 233 are configured to rest on respective sidewalls of the base 300, thereby eliminating the need for a bottom wall. This arrangement also reduces the size of the base 300 relative to the size of the weight plates 227-229. The weight plates 227-229 preferably have rounded corners to eliminate sharp edges and to facilitate both insertion of the weight plates 227-229 into the base 330 and insertion of the handle assembly 110 into the weight plates 227-229.

The handle assembly 110 includes an intermediate hand grip or handle 120 that is shown by itself in FIGS. 25-26. The handle 120 is preferably an extruded plastic member that may be described as a cylindrical tube. The exterior of the handle 120 may be knurled, contoured, and/or coated to facilitate a comfortable and reliable grip. The outside diameter defined by the tube is 1.125 inches, and the inside diameter defined by the tube is 0.75 inches. A groove or keyway 122 is provided along the internal sidewall of the handle 120, and the keyway 122 extends axially the length of the handle 120 (five and one-half inches).

The handle 120 is mounted on a bar 130 that is shown by itself in FIGS. 22-24. The bar 130 is preferably made of steel, and may be described as a modified cylindrical rod that defines a longitudinal axis. An intermediate portion of the bar 130 is five and one-half inches long and defines an outside diameter of 0.75 inches. In other words, the handle 120 is configured to fit snugly onto the intermediate portion of the bar 130. A groove or keyway 132 extends axially along the intermediate portion of the bar 130, which is otherwise cylindrical in shape. The groove 132 in the bar 130 is similar in size and shape to the groove 122 in the handle 120, and a pin or key (not shown) is inserted through the aligned grooves 122 and 132 to key the handle 120 against rotation relative to the bar 130. Other arrangements, including radially extending pins or screws may be used in the alternative to secure the handle 120 to the bar 130. Also, an alternative bar may be manufactured with the handle forming an integral portion thereof.

Opposite end portions of the bar 130 are provided with diametrically opposed flat surfaces 134 and 136. Each of the flat surfaces 134 extends axially along the entire length of a respective end portion (four and five-eighths inches), and each of the flat surfaces 136 extends only one-quarter inch inward from a respective distal end. One of the longer flat surfaces 134 is circumferentially aligned with the groove 132 and accommodates insertion of the key between the handle 120 and the bar 130. The other longer flat surface 134 is diametrically opposed.

The flat surfaces 134 and 136 on the bar 130 are configured to receive respective ends of respective brackets 140, one of which is shown by itself in FIGS. 18-21. Each bracket 140 is preferably a steel plate that has been bent into a U-shaped configuration, including an intermediate strip 141, an inside flange 142 having an elliptical shape, and an outside flange 145 having a rectangular shape. Prior to assembly of the dumbbell 100, the angles defined between the strip 141 and each of the flanges 142 and 145 are preferably slightly greater than ninety degrees for reasons discussed below.

A generally D-shaped opening 144 extends through the inside flange 142 and is configured to fit snugly onto either end portion of the bar 130 (because the longer flat surfaces 134 are diametrically opposed, and the shorter flat surfaces 136 are diametrically opposed). In other words, the inside flange 142 is slidable into abutment against either end of the intermediate portion of the bar 130. An opening 146 extends through the outside flange 145 and is configured to fit snugly onto either distal end of the bar 130 and into abutment against the remainder of the end portion. As discussed below, a weight indicator 160 and three weight engagement members 167-169 are mounted on each end portion of the bar 130 prior to a respective outside flange 145. The opening 146 is bounded by two diametrically opposed cylindrical surfaces and two diametrically opposed flat surfaces which cooperate to define an opening similar to the profile of the distal ends of the bar 130 (shown in FIG. 23). The openings 144 and 146 cooperate with the bar 130 to key the bracket 140 against rotation relative to the bar 130. Other arrangements, including welding or keying, may be used in the alternative.

Threaded holes 138 extend into respective distal ends of the bar 130 to receive respective fasteners 108, one of which is shown by itself in FIG. 27. Each fastener 108 may be described as a bolt having a threaded shaft (not shown) and a relatively larger diameter head. A tool receiving opening 108 is preferably provided in the head of the fastener 108 to facilitate tightening of the fastener relative to the bar 130 by means of a wrench or other appropriate tool. The fasteners 108 cooperate with the intermediate portion of the bar 130 to prevent axial movement of the brackets 140 and/or the weight engagement members 167-169. The slightly divergent configuration of the flanges 142 and 145 provides a spring washer sort of effect.

Each bracket 140 is configured to maintain the weight plates 227-229 in the same relative positions as the base 300. In this regard, the strip 141 is configured to fit inside the slots 207 in the weight plates 227-229, and three pairs of tabs 147-149 extend outward from opposite sides of the strip 141. The tabs 147 cooperate with the inside flange 142 to define a first weight slot 157 configured to accommodate the weight plate 227. The tabs 148 cooperate with the tabs 147 to define a second weight slot 158 configured to accommodate the weight plate 228. The tabs 149 cooperate with the tabs 148 to define a third weight slot 159 configured to accommodate the weight plate 229.

Figure 10:
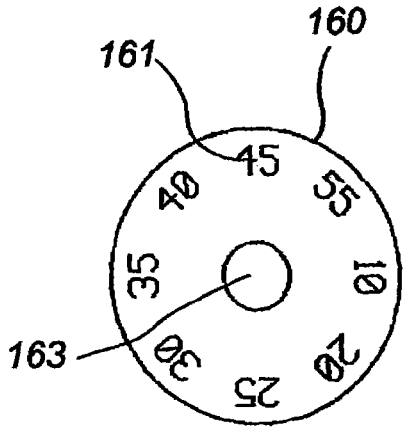
FIG. 10 is an end view of a weight indicator on the dumbbell of FIG. 1.
Figure 11:
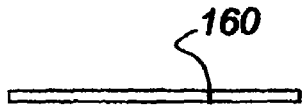
FIG. 11 is a side view of the weight indicator of FIG. 10.
Figure 12:
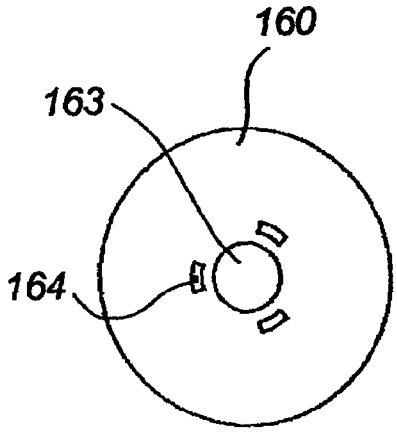
FIG. 12 is an opposite end view of the weight indicator of FIG. 10.

As noted previously, a weight indicator 160 and a group of three weight engagement members 167-169 are mounted on each end portion of the bar 130. One of the weight indicators 160 is shown by itself in FIGS. 10-12. Each weight indicator 160 is preferably an injection molded plastic disc. A circular hole 163 extends through the center of the indicator 160 and defines an inside diameter of slightly more than 0.75 inches. In other words, the indicator 160 is configured to be rotatably mounted on either end portion of the bar 130. Circumferentially spaced weight indicia 161 are provided on a first side of the indicator 160. The weight indicia 161 are arranged to appear one at a time through a window 143 in the inner flange 142 when the indicator 160 is properly positioned on the bar 130. Also, circumferentially spaced slits 164 are provided in an opposite, second side of the indicator 160 to facilitate a rotational link between the indicator 160 and the weight engagement members 167-169, as further discussed below.

Figure 7:
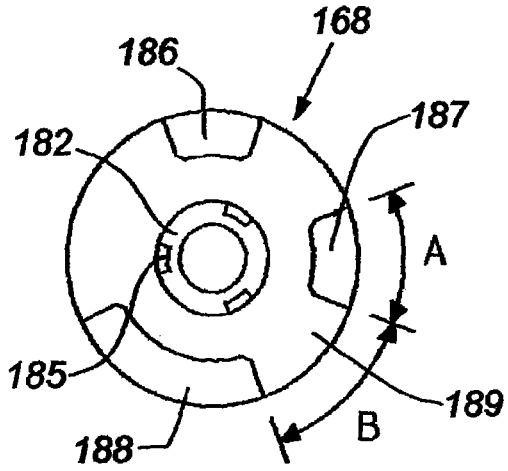
FIG. 7 is an end view of a weight engagement member on the dumbbell of FIG. 1.
Figure 8:
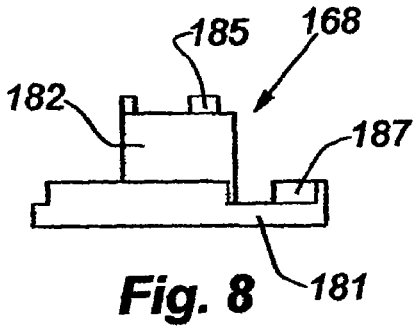
FIG. 8 is a side view of the weight engagement member of FIG. 7.
Figure 9:
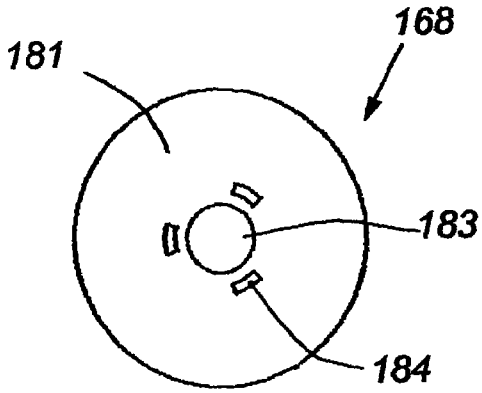
FIG. 9 is an opposite end view of the weight engagement member of FIG. 7.

FIGS. 7-9 show one of the middle weight engagement members 168 by itself. Each weight engagement member 167-169 is preferably an injection molded plastic member that includes a disc portion 181 and an orthogonally projecting hub (designated as 182 on the weight engagement member 168). The disc portion 181 is similar in size and shape to the indicator 160, but twice as thick. The hub portion 182 is concentrically aligned with the disc portion 181 and configured both to fit inside the slot 207 in a respective weight plate 227-229, and to span the thickness of a respective weight plate 227-229.

A circular hole 183 extends through both the disc portion 181 and the hub 182 and defines an inside diameter of slightly more than 0.75 inches. In other words, the weight engagement members 167-169 are configured to be rotatably mounted on either end portion of the bar 130. Circumferentially spaced slits 184 are provided in the side of the disc portion 181 opposite the hub 182 to similarly facilitate a rotational link between the indicator 160 and the weight engagement members 167-169. In this regard, circumferentially spaced tabs 185 project outward from a distal end of the hub 182. The tabs 185 on the weight engagement member 168 are configured for insertion into the slits 184 in the adjacent weight engagement member 167. Similar tabs on the weight engagement member 167 are configured for insertion into the slits 164 in the weight indicator 160, and similar tabs on the weight engagement member 169 are configured for insertion into the slits 184 in the weight engagement member 168.

Each of the weight engagement members 167-169 has at least one lip portion that extends axially away from a radially outward portion of a respective disc portion 181. On each of the weight engagement members 167-169, the at least one lip portion spans a plurality of sectors disposed about the hub, leaving gaps in the remaining sectors. Each hub and its associated lip portion(s) cooperate to define a ring of space therebetween. This ring of space is configured to accommodate the nub 208 on a respective weight plate 227-229 when the hub is resting inside the slot 207 in the respective weight plate 227-229. In other words, the arrangement facilitates rotation of the lip portion(s) on the weight engagement members 167-169 about the nubs 208 on respective weight plates 227-229.

Each interconnected group of weight engagement members 167-169 cooperates to define a rotatable weight selector. On the dumbbell 100, each weight selector is selectively rotatable into eight different weight engaging orientations. For each of the weight engagement members 167-169, as well as the indicator 160, five of these available orientations are shown in FIGS. 13-17. An angle of forty-five degrees is defined between each successive orientation or sector.

Figures 13, 14, 15, 16, 17:
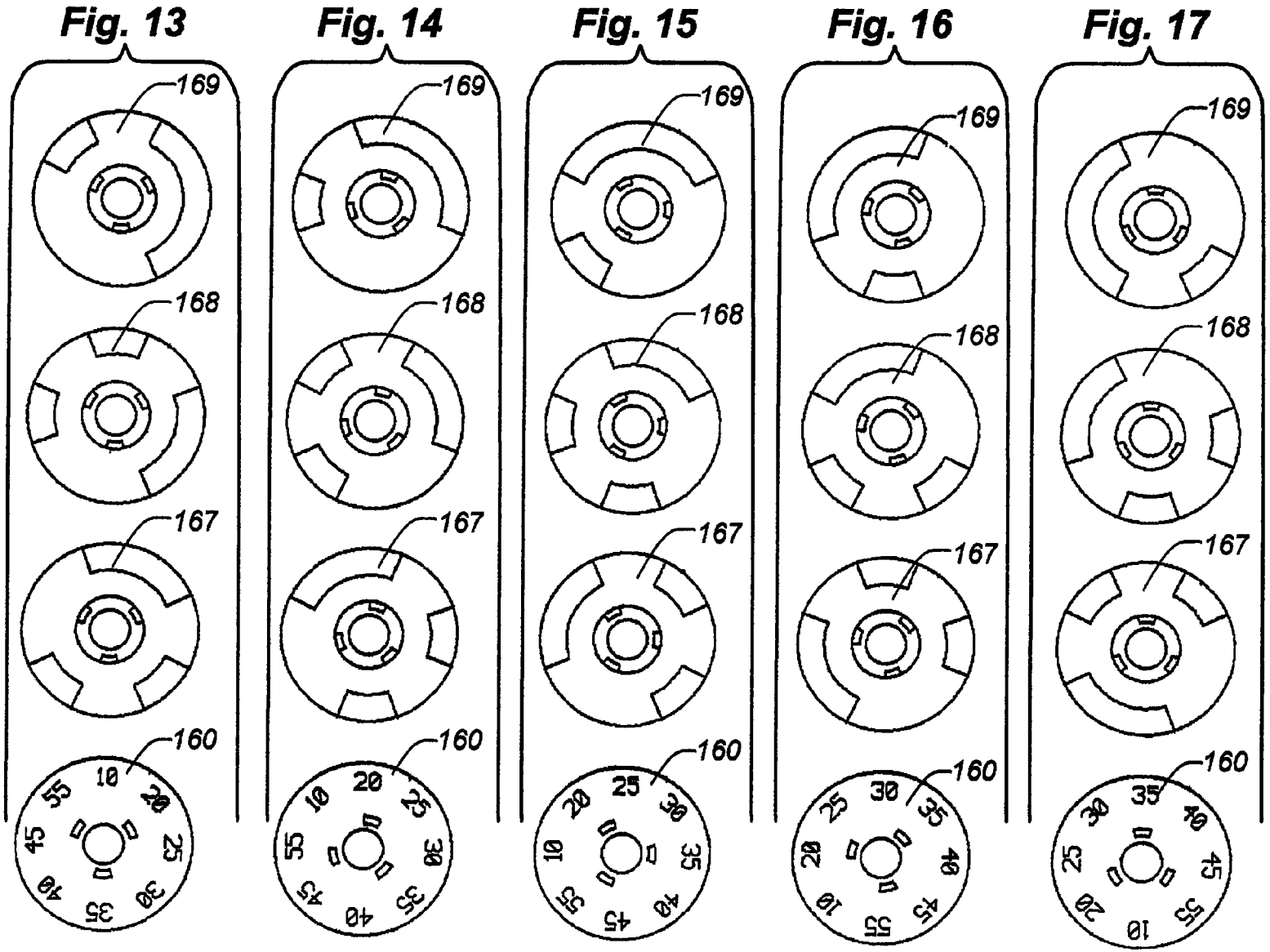
FIG. 13 is an exploded end view of the weight engagement member of FIG. 7, the weight indicator of FIG. 10, and two additional weight engagement members, as they occupy a first orientation on the dumbbell of FIG. 1.
FIG. 14 is an exploded view of the weight engagement members and weight indicator of FIG. 13, as they occupy a second orientation on the dumbbell of FIG. 1.
FIG. 15 is an exploded view of the weight engagement members and weight indicator of FIG. 13, as they occupy a third orientation on the dumbbell of FIG. 1.
FIG. 16 is an exploded view of the weight engagement members and weight indicator of FIG. 13, as they occupy a fourth orientation on the dumbbell of FIG. 1.
FIG. 17 is an exploded view of the weight engagement members and weight indicator of FIG. 13, as they occupy a fifth orientation on the dumbbell of FIG. 1.
Figure 21:
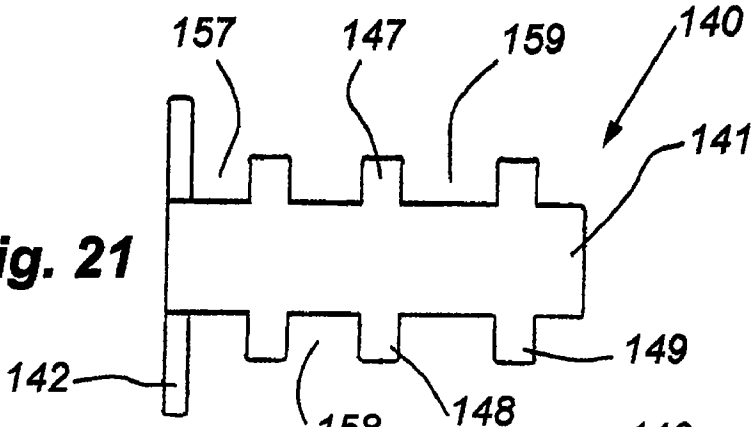
FIG. 21 is a top view of the bracket of FIG. 18.
Figure 18:
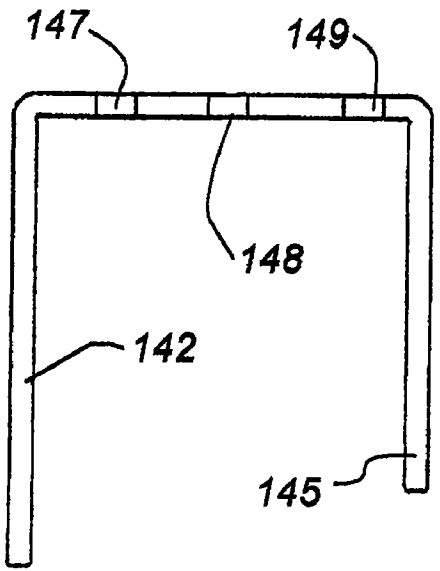
FIG. 18 is a side view of a bracket on the dumbbell of FIG. 1.
Figure 20:
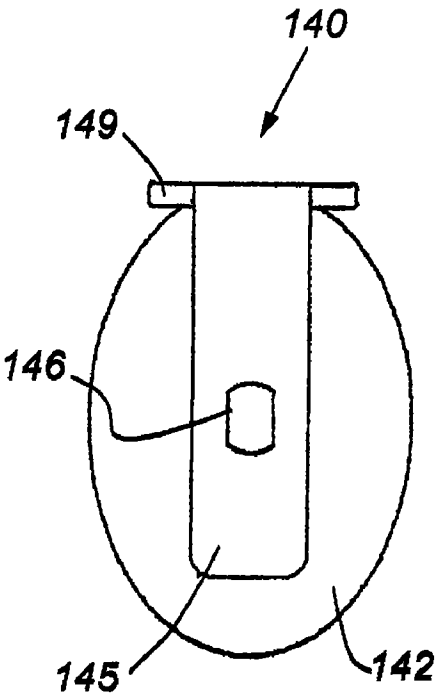
FIG. 20 is an outside end view of the bracket of FIG. 18.
Figure 19:
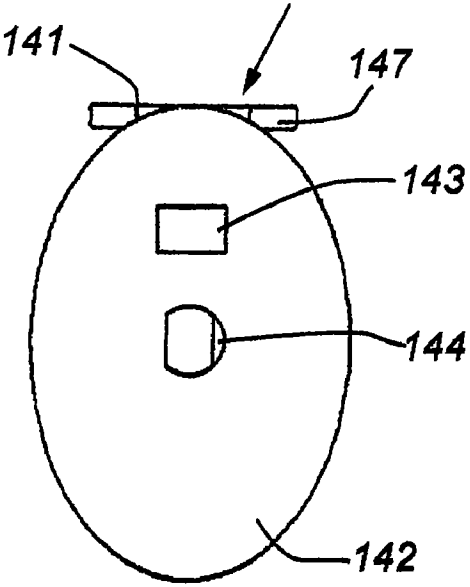
FIG. 19 is an inside end view of the bracket of FIG. 18.

In FIG. 13, the "10" on the indicator 160 is positioned to appear in the window 143, and none of the weight engagement members 167-169 has a lip portion positioned to underlie or hook a respective nub 208 (at 6:00). As a result, when the handle assembly 110 is lifted from the loaded base 300 shown in FIG. 2, all of the weight plates 227-229 remain at rest on the base 300. The "10" on the indicator 160 correctly indicates that the empty handle assembly 110 weighs ten pounds.

The indicator 160 and the weight engagement members 167-169 are rotated forty-five degrees counter-clockwise to arrive at the orientations shown in FIG. 14. The indicator 160 now displays a "20" in the window 143, and the weight engagement member 167 has a lip portion positioned to underlie a respective weight plate 227. With both weight engagement members 167 occupying this same orientation, both five pounds plates 227 are latched to the handle assembly 110. The "20" on the indicator 160 correctly indicates that the handle assembly 110 will now weigh twenty pounds when lifted from the base 300.

FIG. 15 shows that the next orientation engages the seven and one-half pound plates 228 while releasing the five pound plates 227. The "25" on the indicator 160 correctly indicates that the handle assembly 110 will now weigh twenty-five pounds when lifted from the base 300.

FIG. 16 shows that the next orientation engages the ten pound plates 229 while releasing the seven and one-half pound plates 228. The "30" on the indicator 160 correctly indicates that the handle assembly 110 will now weigh thirty pounds when lifted from the base 300.

FIG. 17 shows that the next orientation engages both the five pounds plates 227 and the seven and one-half pound plates 228 while releasing the ten pound plates 229. The "35" on the indicator 160 correctly indicates that the handle assembly 110 will now weigh thirty-five pounds when lifted from the base 300.

In the next orientation (not shown), the five pound plates 227 remain engaged, the seven and one-half pound plates 228 are released, and the ten pounds plates 229 are engaged. The "40" on the indicator 160 will correctly indicate that the handle assembly 110 is set to weigh forty pounds when lifted from the base 300.

In the next orientation, the five pound plates 227 are released, the seven and one-half pound plates 228 are engaged, and the ten pounds plates 229 remain engaged. The "45" on the indicator 160 will correctly indicate that the handle assembly 110 is set to weigh forty-five pounds when lifted from the base 300.

In the last available orientation, all of the plates 227-229 are engaged, and the "55" on the indicator 160 will correctly indicate that the handle assembly 110 is set to weigh fifty-five pounds when lifted from the base 300.

As shown in FIGS. 7-8, the weight engagement member 168 has three circumferentially spaced lip portions 186-188, and three circumferentially spaced gaps (one of which is designated as 189). The gap 189 spans an angle B of fifty degrees, and the lip portion 187 spans an angle A of forty degrees. As suggested by this example, two and one-half degrees of added "play" or tolerance are provided on each side of each gap to reduce the possibility of "snagging" a nub 208 on a weight plate that is not supposed to be selected.

In addition to engaging a desired combination of weight plates 227-229, each weight selector cooperates with a respective bracket 140 to maintain desired axial spacing of the weight plates 227-229. In this regard, the hub 182 on the weight engagement member 168 projects axially beyond the lip portions 186-188 to an extent that is slightly greater than the thickness of a weight plate 228. In other words, the hub 182 on the weight engagement member 168 is long enough to axially span both the lip portions 186-188 and one of the weight plates 228. As a result, the weight plate 228 is slidably retained between the lip portions 186-188 on the weight engagement member 168 and the disc portion 181 on an adjacent weight engagement member 167.

The weight engagement members 167 are generally similar to the weight engagement members 168, though their hubs are shorter (because the weight plates 227 are thinner), and their lip portions are arranged differently. The weight engagement members 169 are also generally similar to the weight engagement members 168. However, in addition to having longer hubs (because the weight plates 229 are thicker), and a different arrangement of lip portions, the weight engagement members 169 are preferably configured to function as knobs, as well. As a result, the weight engagement members 169 have a relatively greater thickness, which is measured axially, and the outside flange 145 on each bracket 140 is preferably configured to facilitate access to opposite sides of a respective knob 169. The outboard flanges 145 also protect against unintended rotation of the knob 169, particularly in cases where a user chooses to rest an end of the dumbbell 100 on his/her thigh.

The outer end walls 309 on the base 300 are notched like the inner end walls 307 to provide additional access to the knobs 169 when the dumbbell 100 is resting on the base 300. The inner end walls 307 are notched to accommodate the inside flanges 142 on respective brackets 140.

Recognizing that the weight selectors rotate to latch and unlatch the weight plates 227-229 relative to the handle assembly 110, the dumbbell 100 is preferably provided with one or more mechanisms to bias and/or lock the weight selectors against unintended rotation relative to the handle assembly 110. One such arrangement is provided on each end of the dumbbell 100 in FIG. 1. In particular, partially spherical depressions 119 extend into the outer surface of each knob 169 at locations spaced forty-five degrees apart from one another. A housing 116 is mounted within the upper outside corner of each bracket 140 immediately above a respective knob 169. A notch is preferably provided in the housing 116 to avoid potential interference problems with the bend in the bracket 140. In a manner known in the art, a ball is movably mounted inside the housing 116 and allowed to project downward beyond the housing 116 and into an aligned depression 119 in the knob 169. A helical coil spring is compressed between the ball and either the overlying strip 141 on the bracket 140 or an upper portion of the housing 116. As a result of this arrangement, the knob 169 tends to click or snap into desired orientations relative to the handle assembly 110, and a threshold amount of torque is required to rotate the knob 169 out of any of these desired orientations. Other possible mechanisms include a leaf spring that deflects into and out of similar depressions, or a spring-biased lever that must first be moved to free the knob for rotation.

On the dumbbell 100, the two weight selectors operate independent of one another. In other words, the weight engagement members 167-169 at one end of the dumbbell 100 may be rotated to the orientation shown in FIG. 14, while the weight engagement members 167-169 at the other end of the dumbbell 100 remain in the orientation shown in FIG. 13. As a result, the opposite end weight indicators 160 will show "20" and "10", respectively, thereby correctly suggesting that the handle assembly 110 will weigh fifteen pounds (the average of ten and twenty) when lifted from the base 300. An advantage of this arrangement is that seven additional weight amounts may be selected. In other words, the dumbbell 100 provides eight different amounts of equally distributed weight, and seven additional amounts of weight that make one end of the dumbbell 100 somewhat heavier than the other end. To the extent that some people may find this imbalance undesirable, they can mitigate the effect by positioning the stronger, "thumb side" of their hand toward the heavier end, and/or adjusting their grip toward the heavier end. In any event, an advantage of the present invention is that relatively few weight plates are required to provide a relatively large number of effective dumbbell weights.

Another advantage associated with the dumbbell 100 involves the use of weight plates 227-229 that weigh five pounds, seven and one-half pounds, and ten pounds, respectively. Although the present invention is not limited in this regard, this particular combination strikes a seemingly desirable compromise between the range of available weights and the magnitude of adjustment between available weights. One alternative option is to use weight plates that weigh two and one-half pounds, five pounds, and ten pounds, respectively. Together with a ten pound handle assembly, this combination would provide a range of ten to forty-five pounds in balanced five pound increments (assuming that the lip portions on the weight engagement members were rearranged to provide proper sequential selection of the weight amounts). In other words, this option provides generally the same magnitude of adjustment increments but with a maximum weight that is ten pounds lighter than the dumbbell 100. Another option is to use weight plates that weigh five pounds, ten pounds, and fifteen pounds, respectively. Together with a ten pound handle assembly, this combination would provide a range of ten to seventy pounds in balanced ten pound increments (again assuming that the lip portions on the weight engagement members were rearranged to provide proper sequential selection of the weight amounts). In other words, this option provides a greater maximum weight but with adjustment increments that are generally double those available with the dumbbell 100.

Many of the details associated with the dumbbell 100 may be modified or changed without departing from the scope of the present invention. Among other things, different amounts of weight, numbers of weight plates, and/or sizes of components may be substituted for those described above. This flexibility extends to the number of available weight selecting orientations, and/or choosing less than all of the possible combinations of weights. For example, the weight selectors may be reconfigured to select ten combinations of four weight plates at each end of the dumbbell, in a manner that provides smaller increments of change at the lower end of the available weight range while also providing a higher maximum weight. The following chart sets forth one possible example involving ten available amounts of balanced weight.

| Knob | Handle | 1st Weights | 2nd Weights | 3rd Weights | 4th Weights | Total |
|---|---|---|---|---|---|---|
| 0° | 10 | 0 | 0 | 0 | 0 | 10 |
| 36° | 10 | 5 | 0 | 0 | 0 | 15 |
| 72° | 10 | 0 | 10 | 0 | 0 | 20 |
| 108° | 10 | 5 | 10 | 0 | 0 | 25 |
| 144° | 10 | 0 | 0 | 20 | 0 | 30 |
| 180° | 10 | 0 | 10 | 20 | 0 | 40 |
| 216° | 10 | 0 | 10 | 0 | 30 | 50 |
| 252° | 10 | 0 | 0 | 20 | 30 | 60 |
| 288° | 10 | 0 | 10 | 20 | 30 | 70 |
| 324° | 10 | 5 | 10 | 20 | 30 | 75 |

Another chart is set forth below to represent another desirable combination of weights. On this particular embodiment, the handle assembly is configured to weigh five pounds; the plates nearest the handle weigh six and one-quarter pounds each; the intermediate weights weigh two and one-half pounds each; and the outermost weights weigh one and one-quarter pounds each. By arranging one weight selector to select only the heaviest weight, and the other weight selector to select only the two lighter weights (see "Split" in the chart), an effective dumbbell weight of fifteen pounds is realized, and the selected weight will feel relatively well balanced because the relative distances between the selected weights and the center of the handle tend to produce offsetting moment arms. In other words, this particular arrangement of weights may be considered advantageous because it provides a ninth, "essentially balanced" weight amount and facilitates a desirable weight range from a marketing perspective.

| Knob | Handle | 1.25's | 2.5's | 6.25's | Total |
|---|---|---|---|---|---|
| 0° | 5 | 0 | 0 | 0 | 5.0 |
| 45° | 5 | 2.5 | 0 | 0 | 7.5 |
| 90° | 5 | 0 | 5 | 0 | 10.0 |
| 135° | 5 | 2.5 | 5 | 0 | 12.5 |
| Split | 5 | 1.25 | 2.50 | 6.25 | 15.0 |
| 180° | 5 | 0 | 0 | 12.5 | 17.5 |
| 225° | 5 | 2.5 | 0 | 12.5 | 20.0 |
| 270° | 5 | 0 | 5 | 12.5 | 22.5 |
| 315° | 5 | 2.5 | 5 | 12.5 | 25.0 |

Design flexibility exists with respect to various other elements, as well, including the location of the indicia for indicating the amount of selected weight, and/or the manner in which such indicia is provided. Also, alternative embodiments may be configured to accommodate knobs or other rotational aids in different locations, including just beyond each end of the handle, as opposed to just inside the distal ends of the dumbbell. Alternative embodiments may also include reconfigured weight engagement members which would, for example, have first and second lip portions that extend axially in opposite directions to selectively engage respective first and second weights on opposite sides of a respective weight engaging member.

Figure 28:
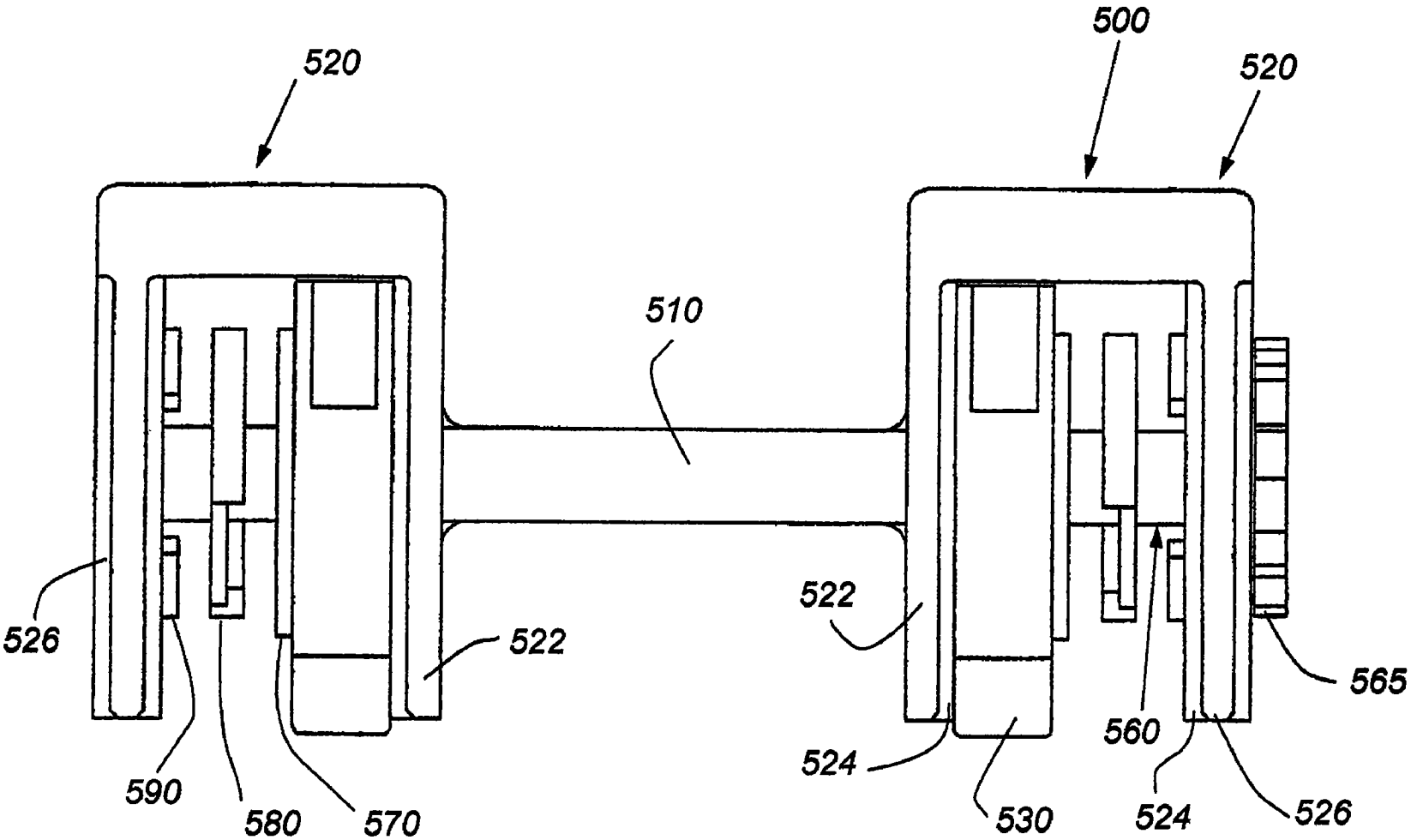
FIG. 28 is a side view of another exercise dumbbell constructed according to the principles of the present invention.
Figure 44:
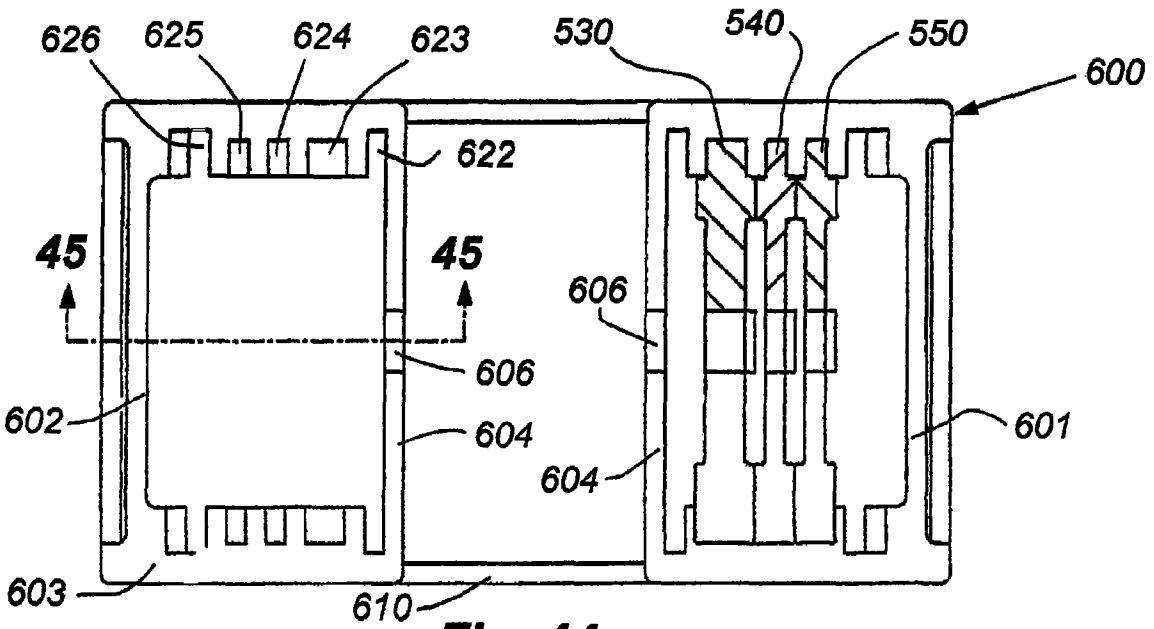
FIG. 44 is a partially sectioned top view of the weights of FIG. 40 resting on a cradle constructed according to the principles of the present invention.
Figure 45:
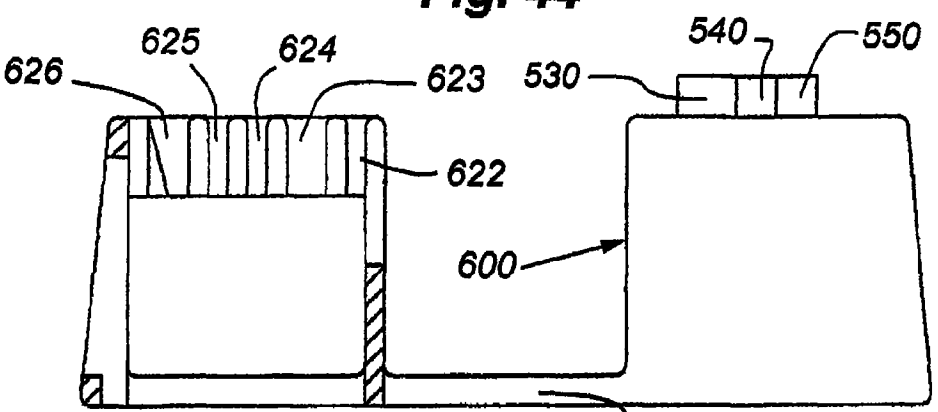
FIG. 45 is a partially sectioned side view of the weights and cradle of FIG. 44.
Figure 46:
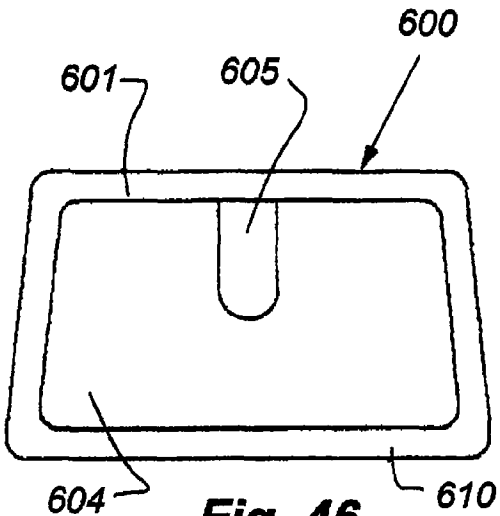
FIG. 46 is an end view of the cradle of FIG. 44 without the weights.

Some of the possible variations of the present invention are embodied on an exercise dumbbell designated as 500 in FIG. 28. This dumbbell 500 has an intermediate handle 510 that is configured for grasping, and opposite end weight housings 520 that are configured to accommodate respective weight plates 530, 540, and 550. When not in use, the weight plates 530, 540, and 550 rest on a base or cradle designated as 600 in FIGS. 44-46.

Figure 29:
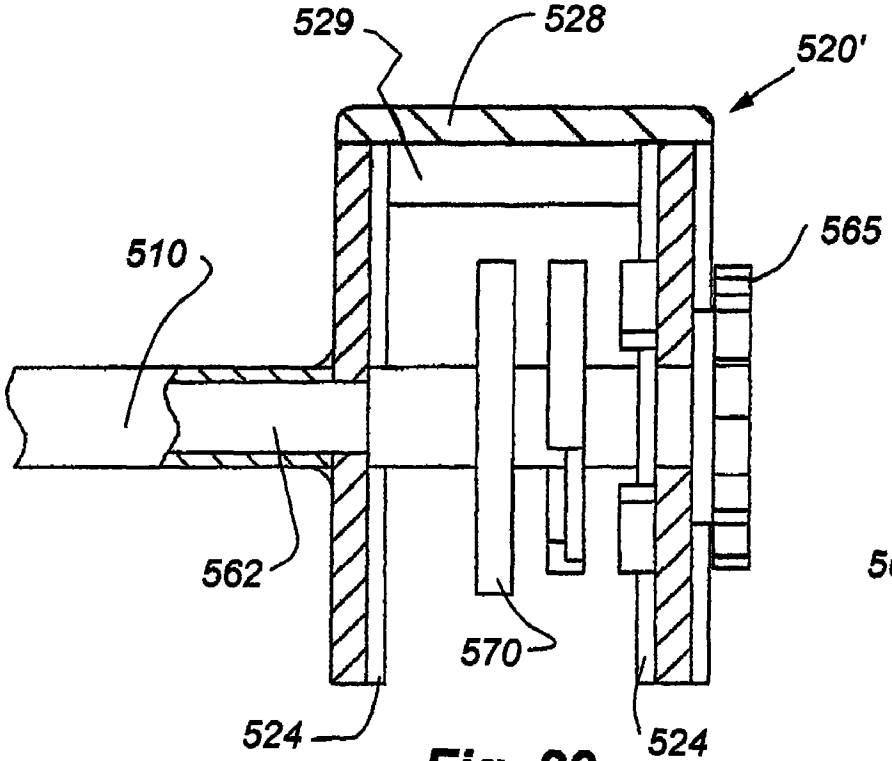
FIG. 29 is partially sectioned side view of one end of the dumbbell of FIG. 28.
Figure 32:
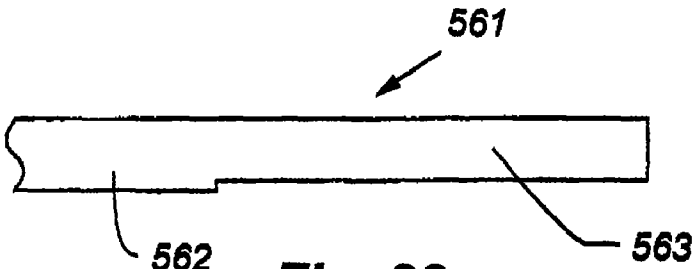
FIG. 32 is a side view of one end of a shaft on the dumbbell of FIG. 28.

The handle 510 is a cylindrical tube that is preferably made of steel. The handle 510 has a longitudinal axis and opposite ends secured to respective housings 520 (by welding or other suitable means). Each of the housings 520 includes an inside end wall 522, an outside end wall 526, a top wall 528, and opposite side walls 529, which cooperate to define a downwardly opening compartment. FIG. 28 shows integrally molded housings 520, and FIG. 29 shows a housing 520' which is identical in size and configuration, but assembled from three discrete parts. In either case, spacers may be provided to extend downward from the top wall 528 and occupy axial spaces between the weight plates 530, 540, and 550. Axially offset shoulders 524 are provided on interior, diametrically opposed sides of each end wall 522 and 526 to engage respective weights 530 and 550 and define centrally located gaps between the weights 530 and 550 and respective end walls 522 and 526. The shoulders 524 are disposed laterally inward from the outside edges of the walls 522 and 526.

A weight selector 560 is rotatably mounted relative to the handle 510 and/or the housings 520. The weight selector 560 includes a shaft 561 and two sets of weight engaging members or weight supports 570, 580, and 590 mounted on the shaft 561. The shaft 561 includes an intermediate portion 562 having a circular profile, and opposite end portions 563 having generally D-shaped profiles (a flat surface extends along an otherwise circular profile). The intermediate portion 562 extends through the handle 510 and through the inside end wall 522 of each housing 520. Each end portion 563 extends through a respective housing 520 and through a respective outside end wall 526.

Figure 34:
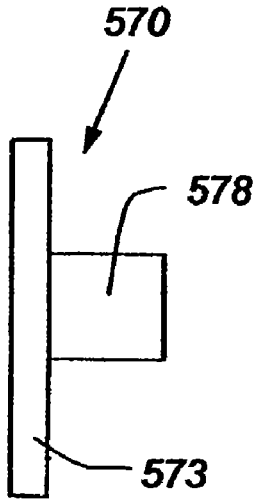
FIG. 34 is a side view of a first weight engaging member on the dumbbell of FIG. 28.
Figure 35:
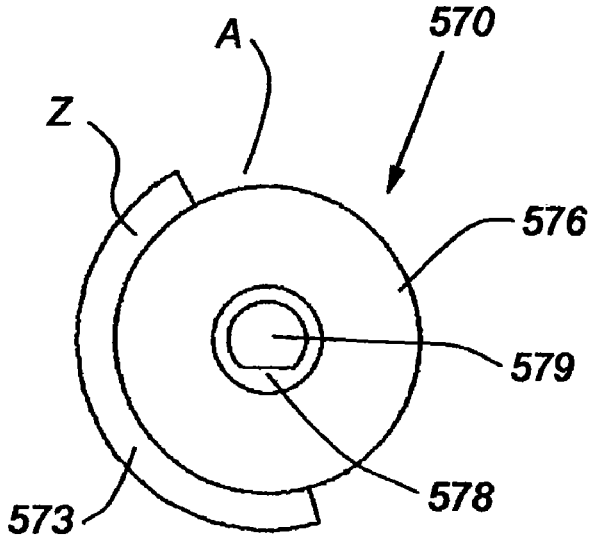
FIG. 35 is an end view of the weight engaging member of FIG. 34.

The innermost weight support 570 is shown by itself in FIGS. 34-35. The support 570 includes an axially extending hub 578, a radially extending rim 576, and an axially extending lip 573. The support 570 is preferably an injection molded plastic member, and the rim 576 may be said to be integrally connected between the lip 573 and the hub 578. An opening 579 extends through the hub 578 and the rim 576, and is configured to fit snugly onto an end 563 of the shaft 561. The lip 573 includes a single, continuous segment or hook that preferably extends through an arc of 167.5°. The lip 573 spans a sector designated as Z in FIG. 35, but does not span the sector designated as A.

Figure 36:
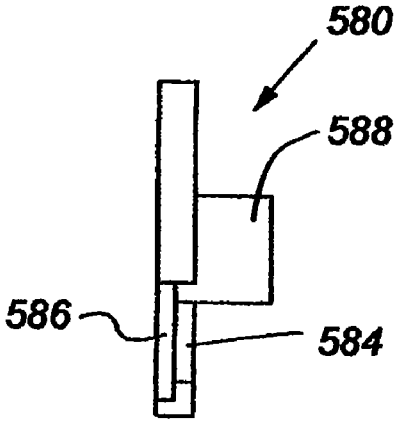
FIG. 36 is a side view of a second weight engaging member on the dumbbell of FIG. 28.
Figure 37:
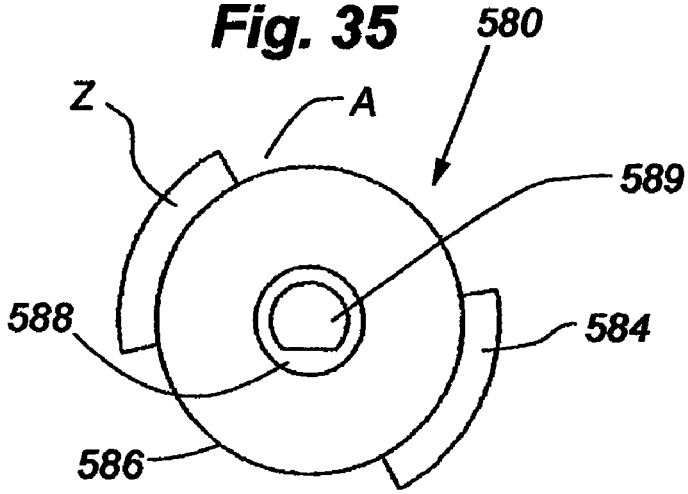
FIG. 37 is an end view of the weight engaging member of FIG. 36.
Figure 38:
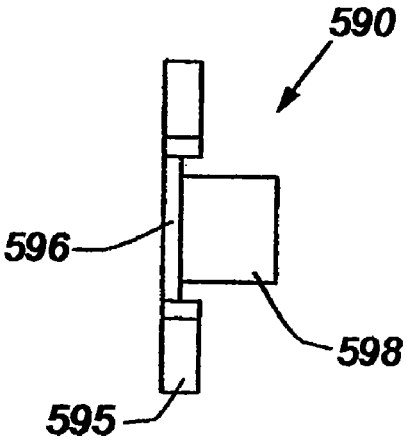
FIG. 38 is a side view of a third weight engaging member on the dumbbell of FIG. 28.

The intermediate weight support 580 is shown by itself in FIGS. 36-37. The support 580 includes an axially extending hub 588, a radially extending rim 586, and an axially extending lip 584. The support 580 is preferably an injection molded plastic member, and the rim 586 may be said to be integrally connected between the lip 583 and the hub 588. An opening 589 extends through the hub 588 and the rim 586, and is configured to fit snugly onto an end 563 of the shaft 561. The lip 583 includes two diametrically opposed segments or hooks that preferably extend through respective arcs of 77.5°. One of the segments spans the sector designated as Z in FIG. 37, but neither of the segments spans the sector designated as A.

Figure 39:
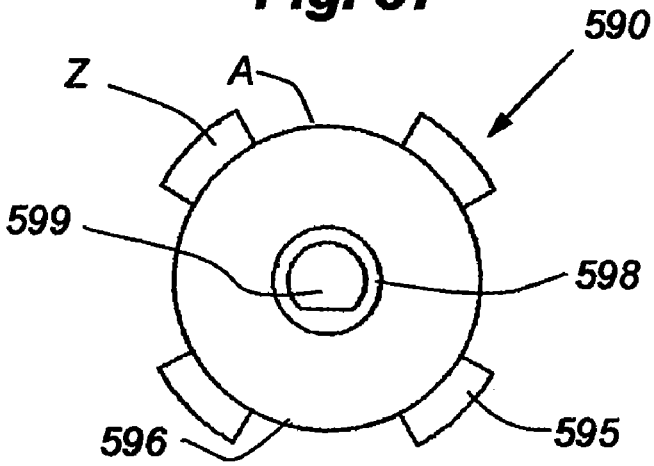
FIG. 39 is an end view of the weight engaging member of FIG. 38.
Figure 40:
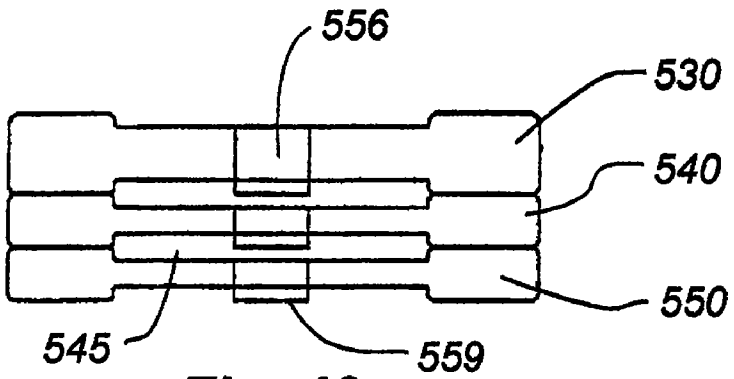
FIG. 40 is a top view of three adjacent weights on the dumbbell of FIG. 28.
Figure 42:
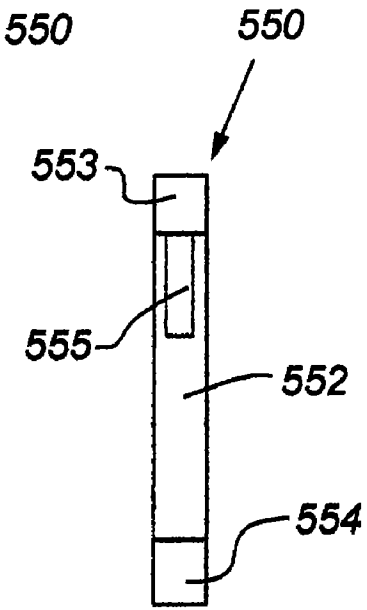
FIG. 42 is a side view of the weight of FIG. 41.
Figure 48:
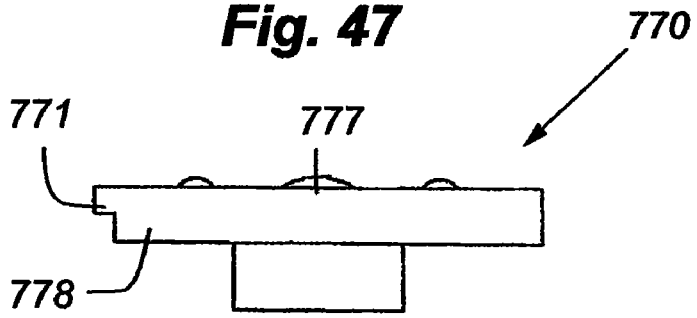
FIG. 48 is a side view of the weight engagement member of FIG. 47.
Figure 49:
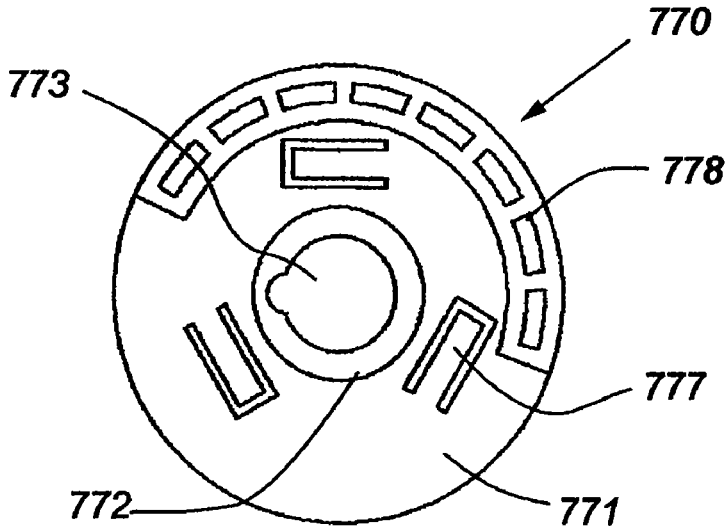
FIG. 49 is an opposite end view of the weight engagement member of FIG. 47.

The outermost weight support 590 is shown by itself in FIGS. 48-49. The support 590 includes an axially extending hub 598, a radially extending rim 596, and an axially extending lip 594. The support 590 is preferably an injection molded plastic member, and the rim 596 may be said to be integrally connected between the lip 593 and the hub 598. An opening 599 extends through the hub 598 and the rim 596, and is configured to fit snugly onto an end 563 of the shaft 561. The lip 593 includes four circumferentially spaced segments or hooks that preferably extend through respective arcs of 32.5°. One of the segments spans the sector designated as Z in FIG. 39, but none of the segments spans the sector designated as A.

Figure 31:
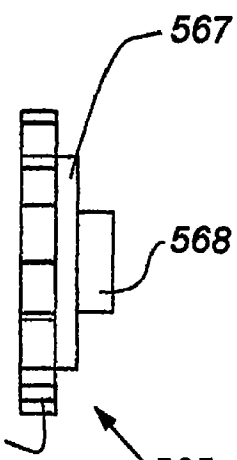
FIG. 31 is an opposite side view of the knob of FIG. 30.
Figure 30:
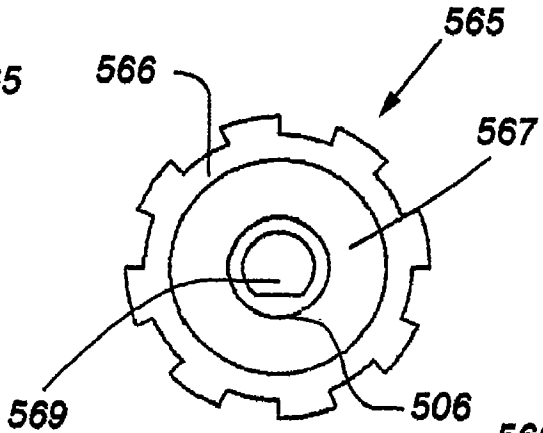
FIG. 30 is an end view of a knob on the dumbbell of FIG. 28.
Figure 33:
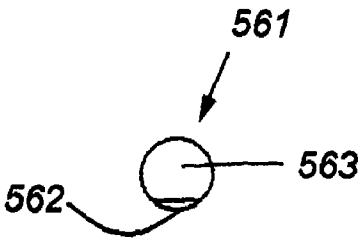
FIG. 33 is an end view of the shaft of FIG. 32.

A fastener is secured to one end 563 of the shaft 561, just beyond an adjacent, outside end wall 526 of a respective housing 520, and a knob 565 is fastened to an opposite end 563 of the shaft 561 just beyond the outside end wall 526 of the other housing 520. As shown in FIGS. 30-31, the knob 565 includes a relatively large diameter rim 566 that is configured for grasping, an intermediate portion 567 that bears against the outside end wall 526, and a relatively small diameter hub 568 that extends through the outside end wall 526. A recess 506 is provided in the hub 568 to receive a fastener in countersunk fashion. Both the knob 565 and both sets of supports 570, 580, and 590 are constrained to rotate together with the shaft 560 relative to the housings 520 and the handle 510. In other words, unlike the dumbbell 100, the dumbbell 500 has first and second weight selectors that are constrained to rotate together relative to the handle 510.

Figure 43:
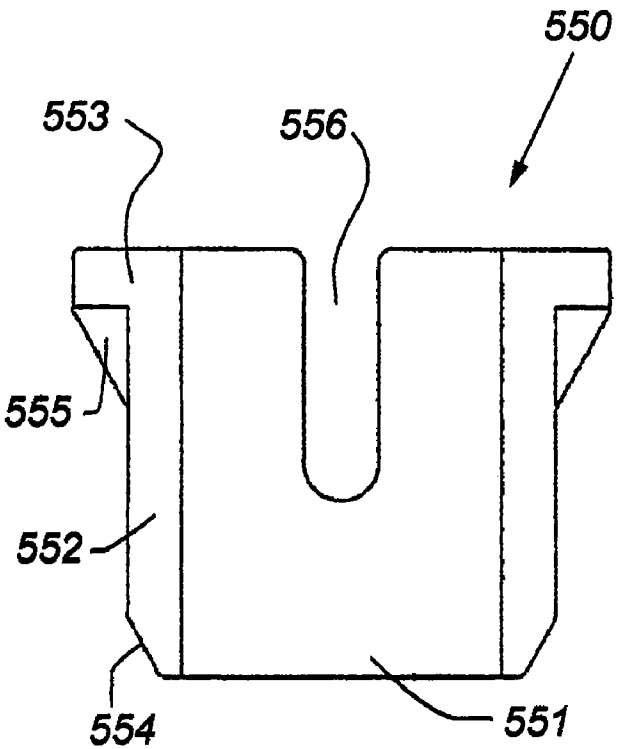
FIG. 43 is an opposite end view of the weight of FIG. 41.
Figure 41:
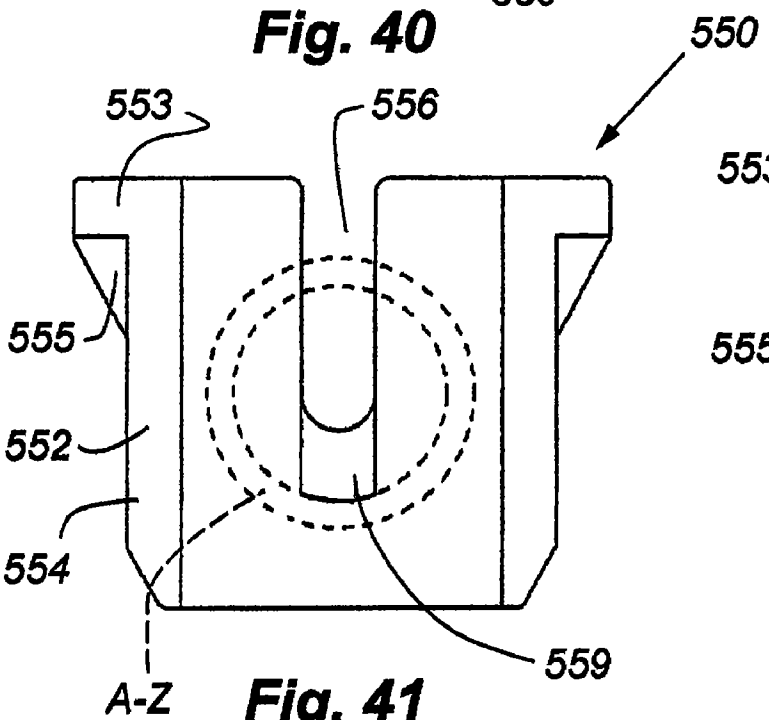
FIG. 41 is an end view of one of the weights of FIG. 40.

The weight plates 530, 540, and 550 are shown in greater detail in FIGS. 40-43. Although the two plates 540 and 550 are shown with the same thickness, the plate 550 weighs one-half as much as the plate 540. The plate 550 may be made from a different density material and/or may be "cored out" to achieve the difference in mass vis-a-vis the plate 540. The plate 530 is configured to weigh twice as much as the plate 540. The end views of the plate 550 shown in FIGS. 41 and 43 are representative of the end views of the other plates 540 and 530.

Each side of the plate 550 (and the plates 540 and 530) may be described with reference to a relatively thinner, intermediate portion 551 and relatively thicker, opposite side portions 552. The side portions 552 bear against adjacent counterparts and/or against shoulders 524 on respective end walls 522 or 526 on the housings 520. The intermediate portion 551 cooperates with adjacent counterparts and/or the end walls 522 or 526 to define gaps 545 disposed between the side portions 552 and the shoulders 524. The gaps 545 are configured to receive respective weight engagement members 570, 580, and 590. FIG. 41 shows how the weight engagement members 590, 580, and 570 axially align with the plates 550, 540, and 530.

An elongate slot 556 extends downward into each of the plates 550, 540, and 530, and is configured to accommodate the axial hub 598, 588, or 578 on a respective support 590, 580, or 570. Just beneath the slot 556, a nub or peg 559 projects axially outward from the intermediate portion 551 of the plate 550 (and each of the plates 540 and 530). The peg 559 is disposed just inside the path A-Z traveled by the axially extending lip 595 on the support 590. As on the dumbbell 100, when a segment of the lip 595 is disposed beneath the peg 559, the plate 550 is "hooked" or constrained to move upward together with the handle 510.

The upper ends of the side portions 552 terminate in respective laterally extending portions 553, which extend away from one another. The lateral portions 553 are the same thickness as the side portions 552. The lower ends 554 of the side portions 552 are beveled or tapered. Relatively thinner, triangular fins 555 extend between respective lateral portions 553 and respective side portions 552. The fins 555 are configured to fit within opposing slots 625 in the base 600, and the lateral portions 553 are designed to rest on top of the ledge 603. Similar fins 555 on the plates 540 and 530 are configured to fit within respective slots 624 and 623 in the base 600. The grooves 623-625 are bounded by inclined, opposing walls which cooperate to center the plates 530, 540, and 550 relative to the base 600. Additional grooves 622 and 626 are provided in the base 600 to receive the end walls 522 and 526, respectively. The grooves 626 are bounded by relatively outward walls which are inclined upward and away from the middle of the base 600.

The base 600 has a bottom 610 that is configured to rest upon a flat surface, such as a table top or floor. Opposite end portions 601 and 602 extend upward from the bottom 610. In addition to outside walls, interior walls 604 extend upward from the bottom 610 and between opposing end walls 522 on respective housings 520. Elongate slots 606 extend downward into the interior walls 604 to accommodate the handle 510. When the plates 530, 540, and 550 are suspended from the base 600, the slots 606 align with the slots 556.

As on the dumbbell 100, the weight selector 560 is designed for rotation in 45.degree. increments, but as discussed above, the present invention is not strictly limited in this regard. Also, a ball detent or other biasing system may be interconnected between the housing 520 and either the knob 565 or the weight selector shaft 561, for example, to bias the weight selector 560 to enter into and remain in the desired orientations.

The lips 573, 584, and 595 are configured to provide a wide berth or an added margin of clearance vis-a-vis the pegs 559. In particular, when any given plate 530, 540, or 550 is not engaged, the respective lip 573, 584, or 595 is at least 6.degree. outside the boundary of the peg 559. With reference to the support 590, for example, each of the lip segments 595 spans an arc of 32.5°.

The configurations of the weight supports 570, 580, and 590, as well as the plates 530, 540, and 550, are such that any combination of the plates 530, 540, and 550 may be secured to the handle 510 for removal from the base 600. In this regard, when the supports 570, 580, and 590 occupy the respective orientations shown in FIGS. 35, 37, and 39, the plates 530 are engaged to the exclusion of the plates 540 and 550. When the supports 570, 580, and 590 are rotated 180°, the sector designated as A underlies the pegs 559 on the plates 530, 540, and 550, and none is secured to the handle 510. When the supports 570, 580, and 590 are rotated until the sector designated as Z underlies the pegs 559, all of the plates 530, 540, and 550 are engaged.

With the handle 510 and the housings 520 designed to collectively weigh ten pounds, and the plates 530, 540, and 550 weighing ten pounds, five pounds, and two and one-half pounds, respectively, the following chart shows how different amounts of weight may be selected as a function of the orientation of the weight selector 560.

| Knob | Handle | Weights 590 | Weights 580 | Weights 570 | Total |
|---|---|---|---|---|---|
| — | 10 | 0 | 0 | 0 | 10 |
| 45° | 10 | 5 | 0 | 0 | 15 |
| 90° | 10 | 0 | 10 | 0 | 20 |
| 135° | 10 | 5 | 10 | 0 | 25 |
| 180° | 10 | 0 | 0 | 20 | 30 |
| 225° | 10 | 5 | 0 | 10 | 35 |
| 270° | 10 | 0 | 10 | 20 | 40 |
| 315° | 10 | 5 | 10 | 20 | 45 |

Like the dumbbell 100, the dumbbell 500 requires only three discrete weights at each end to provide eight different balanced dumbbell loads. Unlike the dumbbell 100, balanced adjustments to the effective weight of the dumbbell 500 may be made by rotating a single knob. Although the unitary weight selector 560 does not accommodate additional, out of balance weight amounts, the number of available dumbbell loads may be doubled by selectively adding opposite end "half-weights" that weigh one-half as much as the plates 590. For example, such half-weights could be connected to the inside end walls 522 by means of hook and loop fasteners or spring clips.

Figure 47:
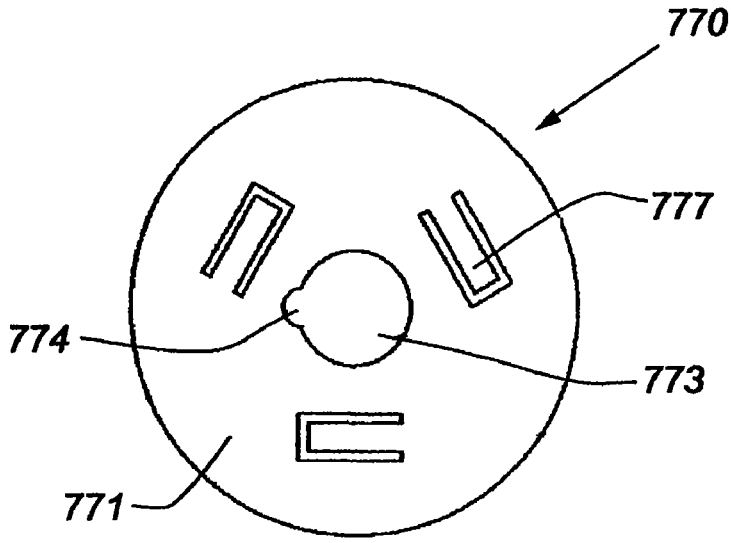
FIG. 47 is an end view of an alternative embodiment weight engagement member suitable for use in accordance with the present invention.

As noted above with respect to the dumbbell 100, several of the details concerning the dumbbell 500 may be modified without departing from the scope of the present invention. Among other things, many of the features and variations discussed above with reference to the dumbbell 100 are applicable to the dumbbell 500, and vice versa. Still another possible modification is depicted on an alternative embodiment weight engagement member designated as 770 in FIGS. 47-49.

Like the weight engagement members on the dumbbells 100 and 500, the weight engagement member 770 includes a radially extending disc portion 771, an axially extending hub portion 772, and at least one axially extending lip portion 778. As shown in FIG. 49, small openings may be provided in the lip portion 778 to improve the strength-to-mass ratio of the part. A cylindrical hole 773 extends through the hub portion 772 and the disc portion 771 to facilitate rotatable mounting of the weight engagement member 770 on a cylindrical shaft. Also, a groove or keyway 774 cooperates with the hole 773 to facilitate keying of the weight engagement member 770 on a cylindrical shaft (in the alternative). Circumferentially spaced leaf springs 777 are integrally formed in the disc portion 771 of the weight engagement member 770. As shown in FIG. 48, the intermediate portion of each leaf spring 777 projects axially beyond the disc portion 771, in a direction opposite the hub portion 772. The purpose of these springs 777 is to "take up" or span any gap between the disc portion 771 and the weight plate that may be caused due to tolerances in the manufacturing process, and/or to impose a clamping force against an adjacent weight plate. In any event, leaf springs 777 must be configured in a manner that any associated clamping and/or friction forces do not cause "unselected" weight plates to rise from the base together with the handle assembly.

The present invention may also be described in terms of various methods of providing adjustable mass to resist exercise motion. Many such methods may be described with reference to the foregoing embodiments. For reasons of practicality, the foregoing description and accompanying figures are necessarily limited to only some of the many conceivable embodiments and applications of the present invention. Other embodiments, improvements, and/or modifications will become apparent to those skilled in the art as a result of this disclosure. Moreover, those skilled in the art will also recognize that aspects and/or features of various methods and/or embodiments may be mixed and matched in numerous ways to arrive at still more variations of the present invention. In view of the foregoing, the scope of the present invention is to be limited only to the extent of the following claims.

What is claimed is:

1. An adjustable dumbbell comprising:

a bar;

a first plurality of weights;

a second plurality of weights;

a first weight selector rotatably associated with the bar; and a second weight selector operatively associated with the bar, wherein:

at least one of the first plurality of weights is operatively associated with and disassociated from the bar by rotating the first weight selector relative to the bar;

at least one of the second plurality of weights is operatively associated with and disassociated from the bar by moving the second weight selector relative to the bar;

the first weight selector is independently movable relative to the second weight selector; and at least one of the first and second weight selectors includes at least one weight engagement member including a disc portion and at least one lip portion extending from the disc portion.

2. The adjustable dumbbell of claim 1, further comprising a base to support at least one of the first and second plurality of weights in a rest position.

3. The adjustable dumbbell of claim 1, further comprising a locking mechanism selectively engageable with the first weight selector, wherein the locking mechanism limits movement of the first weight selector relative to the bar when engaged with the first weight selector.

4. The adjustable dumbbell of claim 3, wherein the locking mechanism comprises at least one of a spring-biased lever and a ball and detent system.

5. The adjustable dumbbell of claim 1, further comprising a handle operatively associated with the bar.

6. The adjustable dumbbell of claim 1, wherein at least a portion of the bar comprises a substantially cylindrical rod.

7. The adjustable dumbbell of claim 1, wherein at least one weight of the first and second plurality of weights comprises a weight plate.

8. An adjustable dumbbell comprising:

a bar;

a first plurality of weights;

a second plurality of weights;

a first weight selector rotatably associated with the bar; and a second weight selector operatively associated with the bar, wherein:

at least one of the first plurality of weights is operatively associated with and disassociated from the bar by rotating the first weight selector relative to the bar;

at least one of the second plurality of weights is operatively associated with and disassociated from the bar by moving the second weight selector relative to the bar;

the first weight selector is independently movable relative to the second weight selector; and the first weight selector comprises a plurality of interconnected weight engagement members and at least one of the weight engagement members defines an aperture for receiving at least a portion of the bar.

9. The adjustable dumbbell of claim 8, wherein:

at least one of the weight engagement members comprises a hub; and at least one disc extends radially outward from the hub.

10. The adjustable dumbbell of claim 8, wherein the first weight selector further comprises a knob operatively associated with at least one of the plurality of weight engagement members.

11. The adjustable dumbbell of claim 9, wherein the first weight selector further comprises at least one weight engagement feature extending from the at least one disc.

12. The adjustable dumbbell of claim 11, wherein the at least one weight engagement feature comprises a lip.

13. An adjustable dumbbell comprising:

a means for grasping the dumbbell;

a first means for increasing the weight of the dumbbell;

a second means for increasing the weight of the dumbbell;

a first means for selectively associating and disassociating the first increasing means with the grasping means by rotating the first selection means relative to the grasping means;

a second means for selectively associating and disassociating the second increasing means with the grasping means by moving the second selection means relative to the grasping means;

the first selection means is independently movable relative to the second selection means; and at least one of the first and second selection means includes at least one weight engagement member including a disc portion and at least one lip portion extending from the disc portion.

14. The adjustable dumbbell of claim 13, wherein at least one of the first and second increasing means comprises a plurality of weights.

15. The adjustable dumbbell of claim 13, wherein at least one of the first and second selection means comprises a plurality of interconnected weight engagement members.

16. The adjustable dumbbell of claim 15, wherein the at least one of the first and second selection means further comprises a knob operatively associated with at least one of the plurality of interconnected weight engagement members.

17. The adjustable dumbbell of claim 13, wherein the at least one weight engagement member comprises a hub with the disc portion extending radially outward from the hub.

18. The adjustable dumbbell of claim 13, further comprising a means for supporting at least one of the first and second increasing means in a rest position.

19. The adjustable dumbbell of claim 18, wherein the support means comprises a base.

20. The adjustable dumbbell of claim 13, wherein the grasping means comprises a handle.

* * * * *